US010081998B2

(12) United States Patent
Tunget

(10) Patent No.: US 10,081,998 B2
(45) Date of Patent: Sep. 25, 2018

(54) METHOD AND APPARATUS FOR STRING ACCESS OR PASSAGE THROUGH THE DEFORMED AND DISSIMILAR CONTIGUOUS WALLS OF A WELLBORE

(71) Applicant: Bruce A. Tunget, Aberdeen (GB)

(72) Inventor: Bruce A. Tunget, Aberdeen (GB)

( * ) Notice: Subject to any disclaimer, the term of this patent is extended or adjusted under 35 U.S.C. 154(b) by 307 days.

(21) Appl. No.: 14/412,960

(22) PCT Filed: Jul. 5, 2013

(86) PCT No.: PCT/US2013/000160
§ 371 (c)(1),
(2) Date: Jan. 5, 2015

(87) PCT Pub. No.: WO2014/007843
PCT Pub. Date: Jan. 9, 2014

(65) Prior Publication Data

US 2015/0152704 A1 Jun. 4, 2015

(30) Foreign Application Priority Data

Jul. 5, 2012 (GB) ..... 1212008.5

(51) Int. Cl.
*E21B 17/20* (2006.01)
*E21B 29/10* (2006.01)
(Continued)

(52) U.S. Cl.
CPC ..... *E21B 29/10* (2013.01); *E21B 17/05* (2013.01); *E21B 17/1021* (2013.01);
(Continued)

(58) Field of Classification Search
CPC . E21B 10/26; E21B 17/14; E21B 4/02; E21B 7/208; E21B 29/10; E21B 33/128;
(Continued)

(56) References Cited

U.S. PATENT DOCUMENTS 2,618,345 A 11/1952 Tucker
2,761,384 A 9/1956 Sweetman
(Continued)

FOREIGN PATENT DOCUMENTS

GB 2471760 A 1/2011
GB 2483675 A 3/2012
(Continued)

OTHER PUBLICATIONS

TAM International, "TAM Inflatable Packer Element Selection," Nov. 2010 (http://www.tamintl.com/images/pdfs/brochures/Element_Brochure.pdf).

(Continued)

*Primary Examiner* — Taras P Bemko

(57) ABSTRACT

Method and apparatus for providing access to a lower end wellbore through an impasse using an circumferential adaptable apparatus and downhole devices to pilot a tool string through an existing obstructive frictional or restricted passageway with dissimilar well bore walls, wherein piloting a tool string may comprise displacing debris within and/or deforming its proximally circular and/or deformed bores or traversing an obstructive passageway therebetween, and whereby various downhole devices may be incorporated, deployed and oriented relative to a proximal axis or proximally contiguous wall, using the expandable and collapsible members of the present invention engaged about a plurality of shafts, usable to pilot the tool string through a conventional impasse or restriction of said walls of said dissimilar contiguous passageways.

50 Claims, 8 Drawing Sheets

(51) Int. Cl.

| | |
|---|---|
| ***E21B 33/128*** | (2006.01) |
| ***E21B 17/05*** | (2006.01) |
| ***E21B 17/10*** | (2006.01) |
| ***E21B 28/00*** | (2006.01) |
| ***E21B 29/00*** | (2006.01) |
| ***E21B 29/02*** | (2006.01) |
| ***E21B 33/12*** | (2006.01) |
| ***E21B 33/134*** | (2006.01) |
| ***E21B 34/06*** | (2006.01) |
| ***E21B 43/10*** | (2006.01) |
| ***E21B 47/00*** | (2012.01) |
| ***E21B 27/00*** | (2006.01) |
| ***E21B 43/117*** | (2006.01) |

(52) U.S. Cl.
CPC ..... *E21B 17/1078* (2013.01); *E21B 17/20* (2013.01); *E21B 27/00* (2013.01); *E21B 28/00* (2013.01); *E21B 29/005* (2013.01); *E21B 29/02* (2013.01); *E21B 33/12* (2013.01); *E21B 33/128* (2013.01); *E21B 33/1208* (2013.01); *E21B 33/134* (2013.01); *E21B 34/06* (2013.01); *E21B 43/10* (2013.01); *E21B 43/117* (2013.01); *E21B 47/0002* (2013.01)

(58) Field of Classification Search
CPC ..... E21B 17/05; E21B 17/1078; E21B 17/20; E21B 28/00; E21B 29/005; E21B 29/02; E21B 33/12; E21B 33/134; E21B 34/06; E21B 43/10; E21B 47/0002; E21B 27/00; E21B 33/1208; E21B 43/117; E21B 17/1021
USPC ..... 166/254.2, 386, 299, 66, 387, 179, 65.1, 166/55.7, 66.4, 298
See application file for complete search history.

(56) References Cited

U.S. PATENT DOCUMENTS

| | | | | |
|---|---|---|---|---|
| 2,942,666 | A | 6/1960 | True et al. | |
| 3,187,813 | A | 6/1965 | Greene | |
| 3,282,347 | A | 11/1966 | Chenoweth | |
| 3,481,402 | A | 12/1969 | Beckett | |
| 3,872,925 | A | 3/1975 | Owen et al. | |
| 3,891,034 | A | 6/1975 | Owen | |
| 4,349,071 | A | 9/1982 | Fish | |
| 4,350,204 | A | 9/1982 | Horton | |
| 4,554,973 | A | 11/1985 | Shonrock et al. | |
| 4,671,356 | A | 6/1987 | Barker et al. | |
| 4,696,343 | A | 9/1987 | Anderson et al. | |
| 5,154,230 | A | 10/1992 | Dees | |
| 5,228,519 | A | 7/1993 | Coronado et al. | |
| 5,271,461 | A * | 12/1993 | Decker | E21B 23/006 166/185 |
| 5,392,856 | A | 2/1995 | Broussard | |
| 6,050,336 | A | 4/2000 | Willauer et al. | |
| 6,076,601 | A | 6/2000 | Mooney | |
| 6,279,970 | B1 | 8/2001 | Eddison et al. | |
| 6,341,654 | B1 | 1/2002 | Wilson et al. | |
| 6,454,001 | B1 | 9/2002 | Thompson et al. | |
| 6,729,406 | B1 * | 5/2004 | Collins | E21B 29/02 166/297 |
| 6,805,056 | B1 | 10/2004 | Poe | |
| 6,896,049 | B2 | 5/2005 | Moyes | |
| 7,172,028 | B2 | 2/2007 | Barbee et al. | |
| 7,591,318 | B2 | 9/2009 | Tilghman | |
| 7,617,880 | B2 | 11/2009 | Loughlin | |
| 7,681,651 | B2 | 3/2010 | Loughlin | |
| 7,878,247 | B2 | 2/2011 | Loughlin | |
| 7,905,291 | B2 | 3/2011 | Misselbrook et al. | |
| 8,109,331 | B2 | 2/2012 | Lynde et al. | |
| 8,166,882 | B2 | 5/2012 | Yang | |
| 8,167,051 | B2 | 5/2012 | Eddison et al. | |
| 2007/0107913 | A1 | 5/2007 | Arnold et al. | |
| 2008/0110673 | A1 | 5/2008 | Giroux et al. | |
| 2008/0217019 | A1 | 9/2008 | Walker et al. | |
| 2008/0230235 | A1 | 9/2008 | Loughlin | |
| 2010/0032154 | A1 | 2/2010 | Gillan | |
| 2010/0276204 | A1 | 11/2010 | Connell et al. | |
| 2011/0168447 | A1 | 7/2011 | Scott et al. | |
| 2011/0240058 | A1 | 10/2011 | Jonassen | |

FOREIGN PATENT DOCUMENTS

| | | | | |
|---|---|---|---|---|
| WO | 2009156736 | A2 | 12/2009 | |
| WO | WO 2009156736 | A2 * | 12/2009 | E21B 4/02 |

OTHER PUBLICATIONS

TAM International, "TAM Thru-Tubing Workover Services," Jul. 2008 (http://www.tamintl.com/images/pdfs/brochures/ThruTubingBrochure.pdf).

* cited by examiner

Fig.3
Prior Art
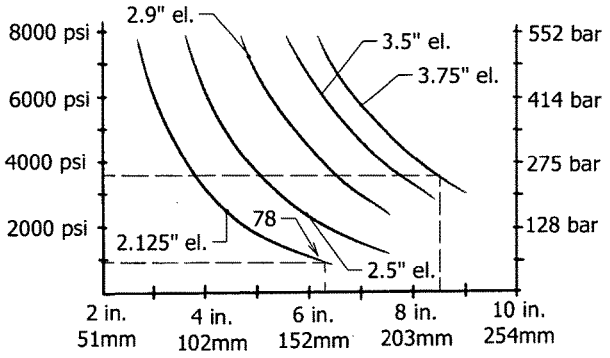
Fig.1
Prior Art
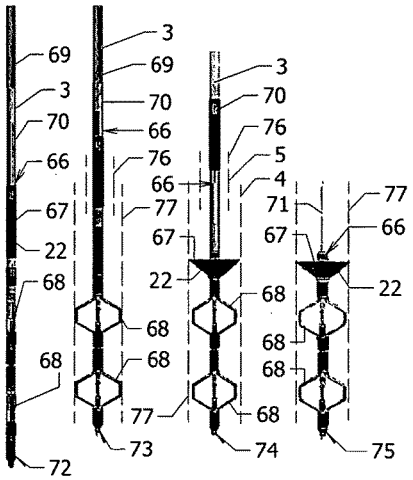
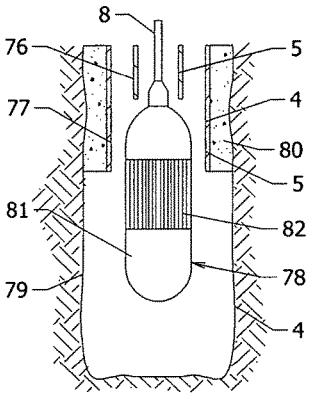
Fig.2
Prior Art
Fig. 5
Section A-A
Fig. 4
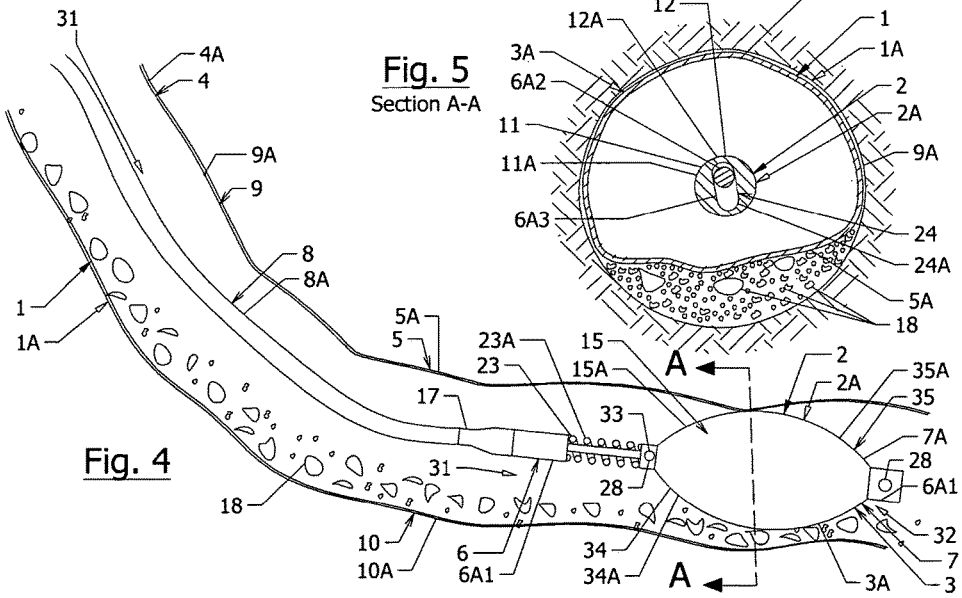

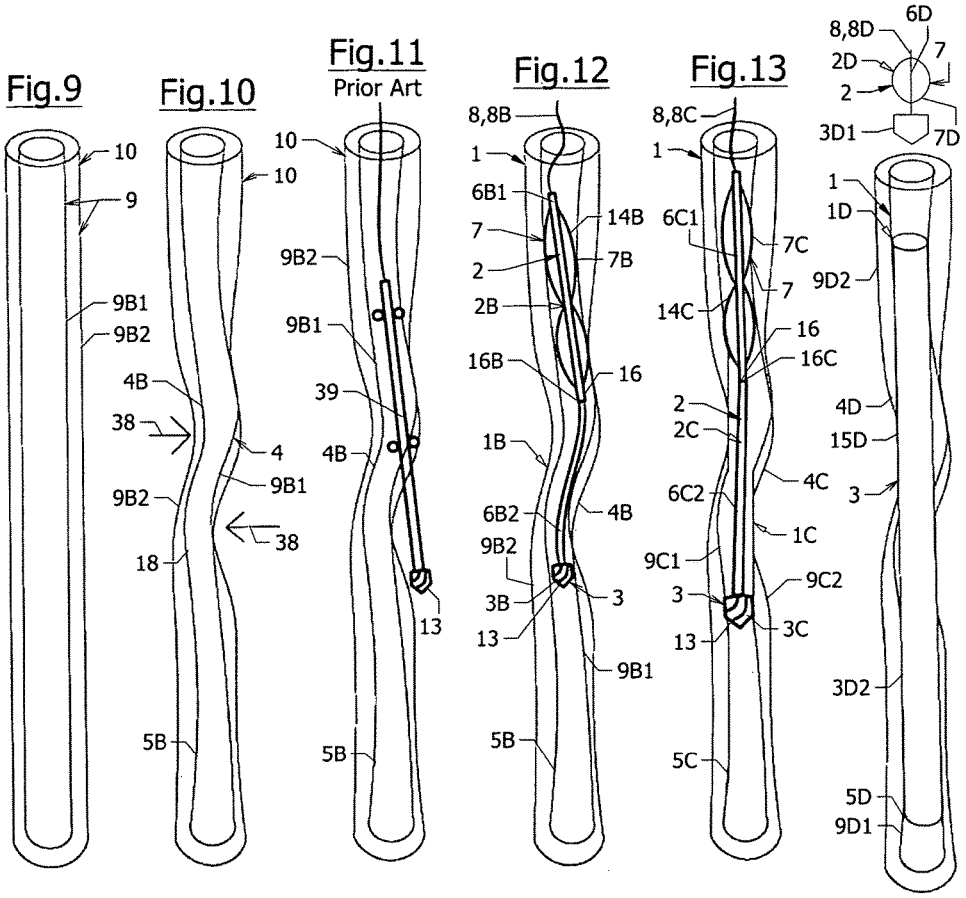
Fig.14
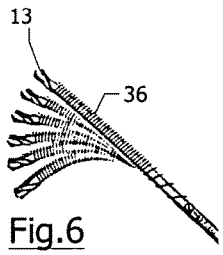
Fig.6
Prior Art
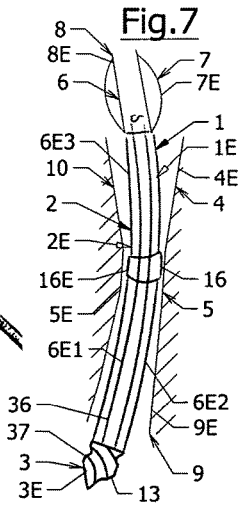
Fig.7
Fig.8
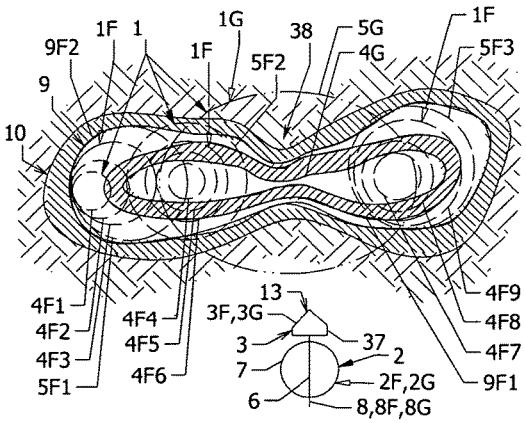

Fig.31
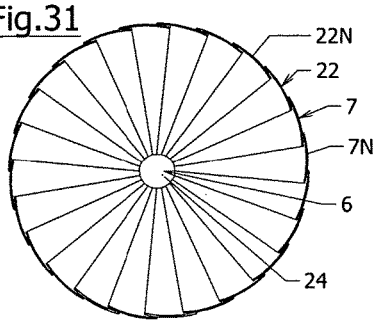
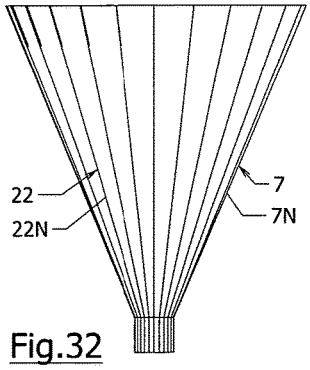
Fig.32
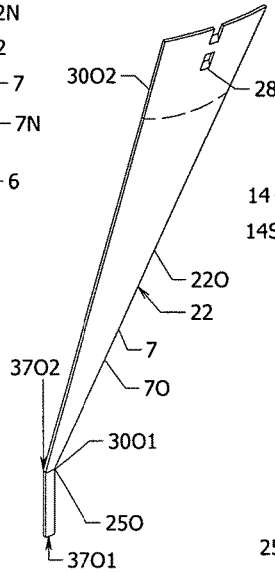
Fig.28
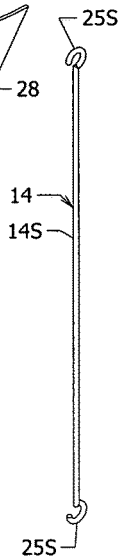
Fig.29
Fig.30
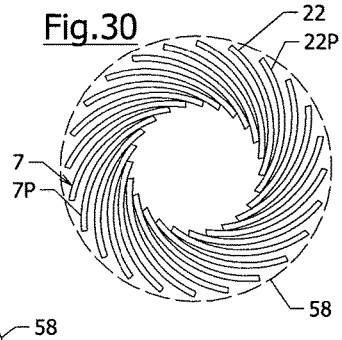
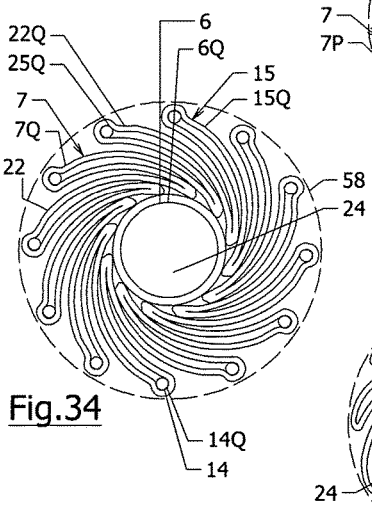
Fig.34
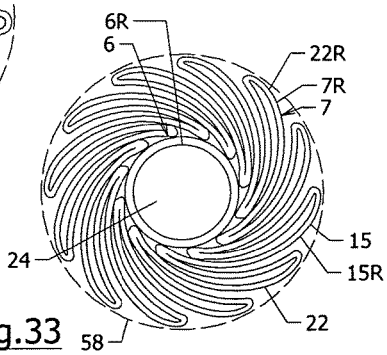
Fig.33
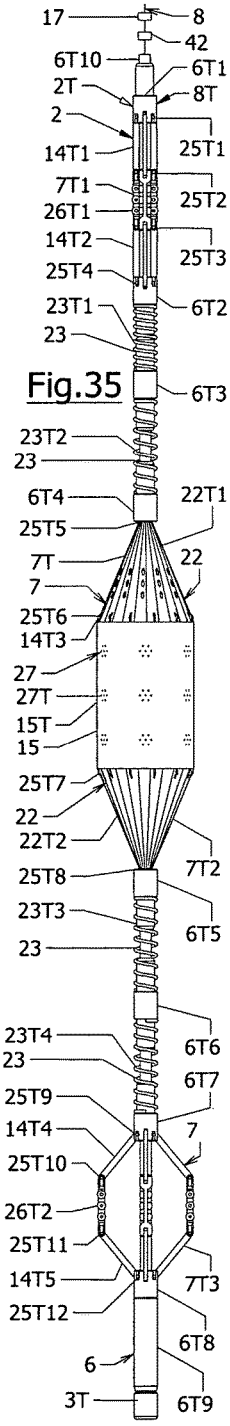
Fig.35

SECTION B-B

DETAIL C

DETAIL M

DETAIL D

DETAIL E

Fig.59
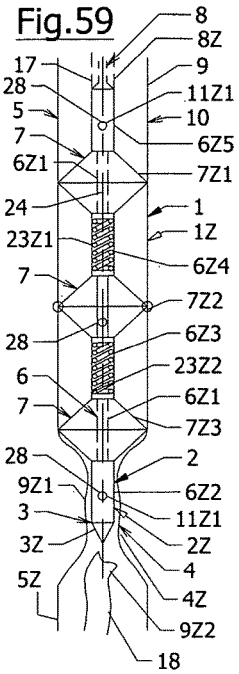
Fig.60
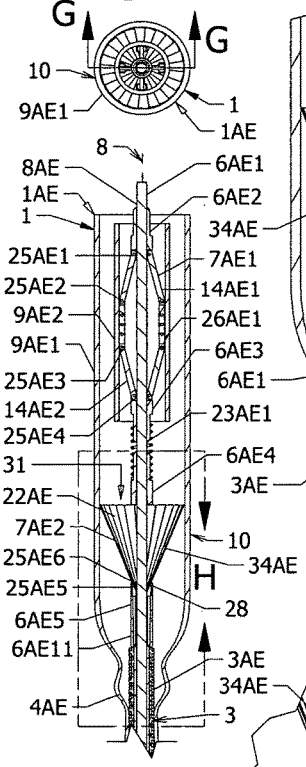
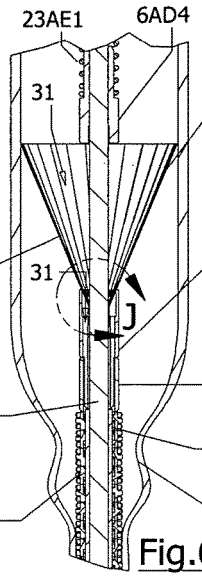
Fig.62
DETAIL H
Fig.64
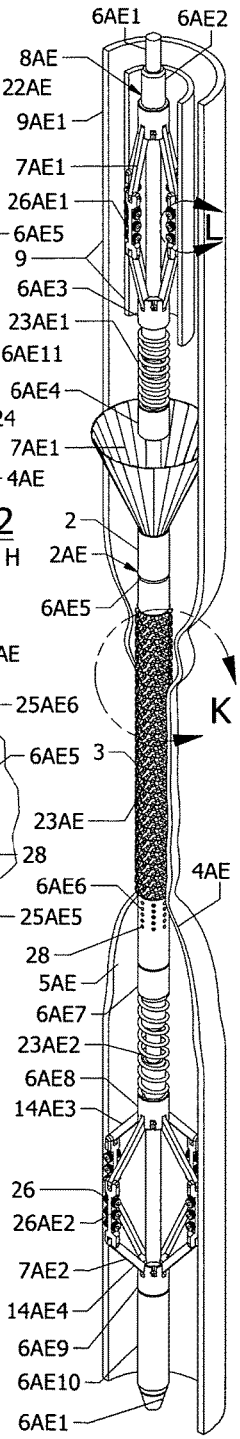
Fig.63
DETAIL J
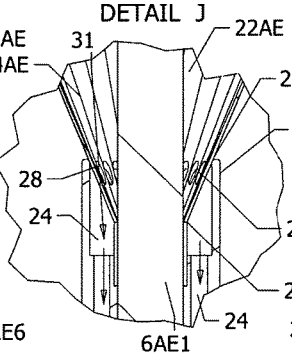
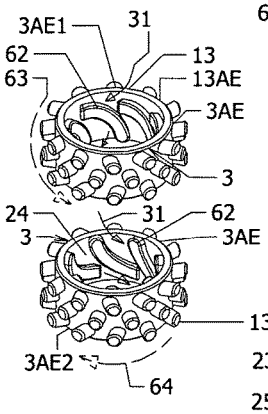
Fig.67
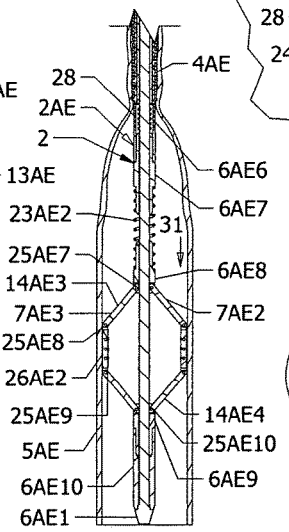
Fig.61
SECTION G-G
Fig.65
DETAIL K
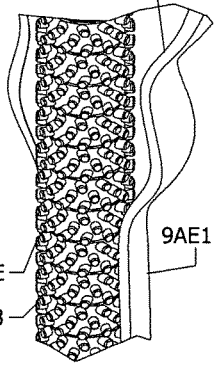
Fig.66
DETAIL L
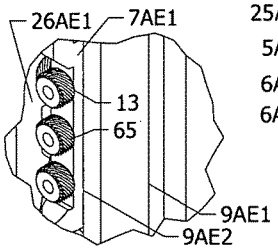

METHOD AND APPARATUS FOR STRING ACCESS OR PASSAGE THROUGH THE DEFORMED AND DISSIMILAR CONTIGUOUS WALLS OF A WELLBORE

CROSS REFERENCE TO RELATED APPLICATIONS

The present application is a U.S. national application that claims the benefit of patent cooperation treaty (PCT) application having PCT Application Number PCT/US2013/000160, entitled "Method And Apparatus For String Access Or Passage Through The Deformed And Dissimilar Contiguous Walls Of A Wellbore," filed 5 Jul. 2013, which claims priority to United Kingdom patent application having Patent Application Number GB1212008.5, entitled "Method And Apparatus For String Access Or Passage Through The Deformed And Dissimilar Contiguous Walls Of A Wellbore," filed 5 Jul. 2012, which claims priority to the United Kingdom patent application having Patent Application Number GB1111482.4, entitled "Cable Compatible Rig-Less Operatable Annuli Engagable System For Using And Abandoning A Subterranean Well," filed 5 Jul. 2011 and published 4 Apr. 2012 under GB2484166A, United Kingdom patent application having Patent Application Number GB1111482.4, entitled "Conventional Apparatus Cable Compatible Rig-Less Operable Abandonment Method For Benchmarking, Developing, Testing And Improving New Technology" filed 19 Sep. 2011, United Kingdom patent application having. Patent Application Number GB1121742.9, entitled "A Space Provision System Using Compression Devices For The Reallocation Of Resources To New Technology, Brownfield And Greenfield Developments," filed 15 Dec. 2011, wherein the description is also published under the related United Kingdom patent application having Patent Application Number GB1121741.1, entitled "Rotary Stick, Slip And Vibration Reduction Drilling Stabilizer With Hydrodynamic Fluid Bearings And Homogenizers," filed 16 Dec. 2011 and published 20 Jun. 2012 under GB2486591, all of which are incorporated herein in their entirety by reference.

FIELD

The present invention relates, generally, to well intervention methods and apparatus using any downhole device operable, with circumferential adaptable apparatus and tool string embodiments, to urge access or passage through a subterranean well bore's obstructive dissimilar contiguous passageway walls formed by, for example, frictionally obstructive debris therein or obstructive circumferences thereof. Obstructive dissimilar contiguous passageways may be the result of, for example (e.g.), wellbore wall deformation due to subterranean strata movements after installation and/or damage to a wellbore from well operations. The present invention relates to methods and apparatus for piloting and traversing tool strings through deformed or, restricted wellbore passageway walls, or deformed and restricted wellbore passageway walls, and can be usable with well intervention, abandonment, suspension and/or planned side-tracking operations, particularly where the proximally contiguous but erratic well bore axis and/or substantially differing wall circumference, along a passageway, prevent or restrict conventional access to a lower end of a well bore.

BACKGROUND

The present invention provides lower cost and/or safer pressure controllable coiled string operations that are preferable to the higher cost operations comprising, e.g., jointed pipe operations with hydraulic workover units and/or drilling rigs carrying out snubbing and stripping operations or well kill and open bore operations.

The present invention relates, generally, to methods and apparatus for piloting and traversing tool strings through deformed or restricted wellbore passageway walls or deformed and restricted wellbore passageway walls by, e.g., cleaning, cutting, bending or abrading the substantially differing diameters along a passageway's walls to remove the frictional forces preventing access or passage. The present invention can be usable with well intervention, abandonment, suspension and/or planned side-tracking operations where the proximally contiguous but erratic well bore axis and/or substantially differing wall circumference along a passageway as a consequence of, e.g., collapse, damage, scale build-up, hole fill, and/or completion tailpipe limitations, prevent or restrict conventional and prior art access to a lower end of a well bore. Conventional or prior art downhole devices can be piloted by the present invention to provide access and passage to said lower end of a wellbore.

The present methods and apparatus can be used to provide access to a lower end of a wellbore through an impasse using various conventional downhole devices selectively arranged to pilot or enlarge an existing frictional or restricted passageway that forms obstructive dissimilar contiguous well bore walls. Embodiments can pilot a tool string to displace debris within, and/or to deform, the proximally circular and/or deformed wellbore's walls. Embodiments may be used to deploy and orient various prior art downhole devices, relative to a proximal axis or proximally contiguous wall, by using the expandable and collapsible members of the present invention, which can be engaged about a plurality of shaft segments that can be usable to pilot tool string embodiments through said impasse or restriction using, e.g., sliding, bending or vibration to circumvent the restraining friction or restrictions to, in use, traverse around said impasse. Embodiments can also include the use of various explosive, hydraulic, electric and/or rotary forces to cut or wedge dissimilar contiguous passageway walls.

Tool string embodiments of the present invention can use the interoperability between coiled string conveyable tools and shafts to pilot the tool string to provide access and to forcibly deform substantially differing circumferences along a wellbore's axis or a contiguous but changing axis. The tool string can be controllably used to deliver substantial hydraulic and explosive forces to, e.g., compress, crush, press, impact, cut, perforate, shear, enlarge or otherwise displace intervening frictional debris or restrictions in or within a wall of a wellbore to provide passage from one passageway to a substantially differing diameter of contiguous passageway, and/or an axially differing subterranean passageway, to provide access or passage to the lower end of a well bore.

The present invention can be used with any type of deployment string, including a coiled string, providing significant benefit over prior art and being applicable to a significantly larger population of wells. Typically, coiled string applications have lower costs with lower well control risks due to the greater pressure control provided by a grease head or stuffing box seal around coiled strings during deployment through the existing above surface well barrier pressure containment envelope, which may be left in place.

The methods and apparatus of the present invention can provide for well intervention, where none has been possible previously, to provide significant benefits. The references cited below, typical of prior art, generally pertain to wireline and coiled string deployment using the limited force of conventional tools that are unable to orient explosive devices axially, because said prior art may be, e.g., propelled out of the well or otherwise become damaged or stuck within the wellbore if operated with the same hydraulic and/or explosive forces that can be usable with the present invention. The present invention can provide the additional benefit of friction reducing methods and apparatus, which can be conventionally usable with coiled tubing and drill strings, but unavailable to wireline.

Existing devices, for example, U.S. Pat. No. 2,618,345, teach wireline conveyable, expandable, axial, pivotal spring slips that are usable with a conical packer engagement to a wall of a well bore; however, such devices, as described in U.S. Pat. No. 2,618,345, could not be fashioned to be movable or to achieve the expanded-diameter-to-collapsed-diameter ratio necessary for passage through, e.g., a collapsed conduit bore's walls. Similarly, U.S. Pat. No. 2,942,666 teaches an expandable membrane with axial pivotal slips for securing a bridge plug or packer within a well, wherein the expanded-diameter-to-collapsed-diameter is greater, and whereby the tool may be deployed through significantly smaller diameters, then enlarged and engaged to the well bore wall; however, like U.S. Pat. No. 2,618,345, U.S. Pat. No. 2,942,666 is intended to be fixed to a bore and not piloted and traversed through obstructive dissimilar contiguous wellbore walls. U.S. Pat. No. 2,761,384 teaches the use of explosives to cut a conduit downhole, but, as is common to such applications, cutting of the conduit occurs transverse to the conduit's axis. Accordingly, if the visual similarity of deployment or fixing of such downhole devices through or to a wellbore wall, or explosively cutting conduits downhole, was obvious, disclosure of U.S. Pat. No. 2,618,345, U.S. Pat. No. 2,761,384 and U.S. Pat. No. 2,942,666 filed in 1948, 1951 and 1956 would have rendered the majority of the remaining cited references obvious.

The methods and apparatus of the present invention provide access or passage through a dissimilar contiguous passageway, and there has been an unresolved need in the oil and gas industry for this technology.

References, such as U.S. Pat. No. 3,187,813, relate to wireline dumping of cement upon, for example, a restriction or bridge plug, as provided by the teachings of U.S. Pat. No. 3,282,347, U.S. Pat. No. 3,481,402, U.S. Pat. No. 3,891,034, U.S. Pat. No. 3,872,925, U.S. Pat. No. 4,349,071, U.S. Pat. No. 4,554,973, U.S. Pat. No. 4,671,356, U.S. Pat. No. 4,696,343, U.S. Pat. No. 5,228,519, U.S. Pat. No. 6,050,336, U.S. Pat. No. 6,341,654, U.S. Pat. No. 6,454,001, U.S. Pat. No. 7,617,880, U.S. Pat. No. 7,681,651, US 2007/0107913 and US 2008/0230235, which recite various baskets, bridge plugs and/or bladders and expandable or axial pivotal wall securing engagements that are visually similar to U.S. Pat. No. 2,618,345 and U.S. Pat. No. 2,942,666, but do not teach the passage of a downhole device past an obstructive restriction. Such prior art may also include the deformable members taught in U.S. Pat. No. 6,896,049, which can be used in a downhole device, and which is silent to the potential deformity of well conduits and piloting of such devices into, e.g., a damaged or debris filled wellbore.

The majority of the existing practices presume a circular well bore without significant restriction to deployment of a downhole device; for example, U.S. Pat. No. 4,696,343 and U.S. Pat. No. 6,454,001 are usable for passage of an axial pivotal collapsed and expandable wireline operable umbrella or basket, deployable through a casing into a substantially different diameter open or uncased open strata hole for engagement with the wall of a well, but are silent to deployment through, for example, a collapsed casing.

Prior art teaches various setting tools, such as U.S. Pat. No. 5,392,856 and U.S. Pat. No. 7,172,028, for baskets, umbrellas and bailers that are usable in, e.g., a wellbore plug back operation, wherein the setting tools may include various triggers, timers, springs, battery packs and/or releasable differential pressure vessels usable for the necessary energy to actuate downhole devices.

However, the prior art is, generally, silent to practicable cost effective means of deploying or urging a downhole device's deployment through, for example, the debris of a collapsed casing section. Despite teaching debris management, U.S. Pat. No. 8,109,331 is silent to the debris of well component failures, like casing or tubing collapse and, generally, cannot be oriented axially downward to either cut or expand a failed well conduit. Similarly, U.S. Pat. No. 5,154,230 teaches the repair of a liner, and the explosive shape charges of U.S. Pat. No. 8,166,882 may be used to cut, for example, a failed and/or collapsed well conduit traverse to a well conduit axis, while U.S. Pat. No. 6,076,601, U.S. Pat. No. 6,805,056 and U.S. Pat. No. 7,591,318 provide a method and apparatus usable for explosively cutting, U.S. Pat. No. 7,591,318 discloses the cutting of a downhole plug and pushing it downhole, and wherein U.S. Pat. No. 7,591,318's numerous cited references teach various means of deforming a downhole well bore; however, the prior art does not teach a practicable means of piloting and orienting "axial" cutting tools downward to sculpt through and/or expand, e.g., the collapsed portion of a deformed liner, and whereby the downward orientation of such prior art would result in launching said prior art upward within the well bore, in a manner similar to a bullet being shot from the barrel of a rifle.

GB2486591, of the present inventor, teaches stator rotation within rotary milling tools using a hydrodynamic fluid bearing arrangement, while US 2011/0168447 teaches a means for passage of a casing through the proximally circular or deformed circumference of a well bore filled with, for example, cuttings from boring, whereby turbine blades are used about the circumference of the downhole device to move debris with a reamer shoe for placement of casing; however, the application is silent regarding cable or wireline compatible deployment of a downhole apparatus, wherein the use of fluid to operate such a turbine from a cable engagement is far from obvious within a obstructive dissimilar contiguous passageway, where circumferences and diameters may significantly vary.

US 2008/0217019, U.S. Pat. No. 7,878,247, U.S. Pat. No. 7,905,291B2, U.S. Pat. No. 4,350,204, US 2010/0032154 and US 2011/0240058 teach various coiled string compatible methods and apparatus for access or passage through a well bore filled with, e.g., cuttings or scale in vertical and horizontal wells, albeit said access and passage comprises the removal of the debris through circulation as a tool string is deployed into a wellbore, wherein the obstruction is always below or in front of the tools string, and whereby said prior art is silent to the interoperability between tools in the deployment string that is necessary to pilot a tool string and traverse through intermediate debris and/or damaged walls, to the lower end of a wellbore, without the removal of said debris and/or damaged walls through the act of milling and well bore circulation.

Various conventional practices may be arranged and deployed using the present invention's methods and/or piloted by the present invention's apparatus. In practice, because the embodiments of the present invention have not been used or practiced in the industry, it is not known, to the oil and gas industry, how smaller and lower cost conventional practices or prior art might be practicably deployed for repeated access and to provide passage to a well's lower end by selective arrangement, piloting and orientation of a tool string relative to substantially differing circumferences along an erratic axis of a contiguous passageway's walls, which can be formed by deformation or damage along and/or debris within or along the dissimilar passageway walls, which is taught herein.

The present invention solves various problems existing in the oil and gas industry, which include the problems described by FIGS. 8 to 11, 14 to 17, and 21, wherein well conduits of significant wall thickness, metal grade and hardness have been collapsed and/or sheared by moving subterranean strata above a carbonate reservoir being driven by a water flood, and whereby the conventional use of milling operations has been unsatisfactory for various reasons, including inadvertent side-tracking of wells, which would result in a complete loss of access to a producing reservoir. Generally, a lack of cementation behind various casing strings, which resulted from difficulties during well construction and were compounded by movable strata formations, could result in leak paths and associated reservoir pressure control issues during conventional milling and/or after abandonment of the well's lower end.

The present invention provides solutions to the industry's problems, as shown FIGS. 8 to 11, 14 to 17, and 21, and the methods and apparatus of the present invention can be adapted for use with conventional downhole devices in addition to the downhole devices of the present inventor.

The methods and apparatus of the present invention can be adapted to be compatible with the present inventor's methods and apparatus of GB2484166A to provide the safe abandonment of damaged wellbores and/or bores with oval shaped casing circumferences that can reduce the effectiveness of, e.g., piston packers, for the crushing of well components to form a geologic sealable space.

Typically, subterranean wells target and exploit subterranean deposits of hydrocarbons, geothermal heat sinks, salt layers or other subterranean features that, generally, have been formed by natural stratigraphic traps and subterranean movements of strata within the earth's crust, which have trapped and formed the desired deposit.

While said strata movements may have trapped the deposits over a geologic time frame, the using or exploiting of a subterranean deposit can change the subterranean pressures and/or the original in place rock stresses formed before exploitation of the deposit. Pressures within strata pore spaces and/or connecting fault planes about a well bore may be increased by injection (e.g. from a water flood) or depleted (e.g. by production) and, thus, can promote or attract fluid pressure and/or strata movements, dependent upon the ability to transmit pressure, that can cause subterranean strata to shift over the life of a well. For example, if an impermeable layer of strata separates a higher pressure porous and/or permeable layer from a lower pressure porous and/or permeable layer, the higher pressure may act upon the impermeable strata and form a very large stratigraphic piston with substantial associated forces comprising the pressure differential multiplied by the area affected, which will typically be measured in square miles or kilometers. When a reservoir pressure is depleted and pressures above the reservoir cannot equalize with the depleted reservoir strata, movement, typically referred to as subsidence, may occur. The injection of water using, e.g., a water flood may tend to equalize pressures or provide insufficient pressure support and/or, exacerbate pressure differentials to lubricate strata faults and cause increased strata movement, which may not necessarily be vertical subsidence, but also lateral shearing.

Protection from various strata layers and the fluid pressure within said strata are, generally, provided by well conduit linings hung from a surface wellhead, commonly referred to as casings, while protective well linings hung from a previous casing are, generally, referred to as liners.

Well construction comprises boring through the subterranean strata, placing protective conduit casings or liners, and cementing the conduits in place prior to using the conduit casings and/or liners, for further boring and/or as a secondary pressure barrier, about a production or storage tubing and associated subterranean completion equipment. Production tubing, packers, control lines, subsurface safety valves and other completion equipment are installed within the casing and/or liner conduits to provide a primary completion pressure barrier within said secondary casing and/or liner barriers, which can prevent the unplanned escape of fluids from a well into the subterranean strata or surface environments.

The intermediate annulus between the completion and casing and/or liner conduits is, generally, a void space used to monitor the status of the primary barrier. This annulus may be used during well construction when a heavy fluid is present within the annulus and/or blowout preventers are placed on the wellhead to provide well control to, for example, place a gravel pack. Once the completion is installed, the blowout preventers must be replaced by the well's valve tree, generally referred to as a Xmas tree. The intermediate annuli, generally, become fluid filled voids used for monitoring the primary and secondary barriers, but they can be used to, for example, provide gas lift to the completion production conduit in wells that are generally incapable of producing significant quantities on their own without stimulation. Other power fluids, such as injected water, may also be circulated through the annulus to operate a jet or a hydraulic pump; or, alternatively, an electrical submersible pump, rod pump or pump jack can be used for wells requiring stimulation to produce in meaningful quantities.

It should be understood that the Xmas tree, wellhead and casings are generally the first and last barriers between subterranean fluids and the surface environment, wherein said casings and completion components deep within a well, generally, have access to annuli passageways connected directly to the surface; hence, the failure of well casings, kilometers below the earth's surface, may represent a serious problem to the surface environment.

Movements or shifting of the subterranean strata from, for example, subsidence of the heavy overburden, hydration and activation of shale, or flowing of mobile salts, can adversely affect and damage casings, liners and completion components through the application of collapse, burst, tensile and/or compressive forces.

The conventional remedy for damaged subterraneanly installed casings, liners and/or completion equipment is their removal through what are generally termed "fishing" operations, since damaged equipment may be difficult to catch and remove, wherein the ability and associated probability of engaging or "catching" and "removing" the "fish" or damaged equipment is uncertain. "Fishing" items that have fallen downhole can be undertaken using various jointed or coiled strings, for example wireline or coiled tubing, whereas heavy duty hydraulic workover units and/or drilling rigs are conventionally used for fishing of heavy components, such as casings, liners and completion equipment.

Additionally, when damaged subterranean equipment cannot be "fished" from the well, it may be ground or milled into small pieces with a rotary drilling rig or hydraulic workover unit to facilitate its removal by using the circulating system to lift said small pieces.

Failures of well components above the lower end of a well are particularly problematic because intermediate well damage may prevent access to the lower end of the well and/or expose lower end well pressures to upper end well components, which are unsuited for such pressures or the forces associated with such abnormal pressure.

Unfortunately, the failure of downhole components and their associated primary and secondary barriers may expose various other well components to forces and pressures that may cause further failure and, ultimately, the unintended release of subterranean fluids to the surface, or other permeable subterranean formations. For example, casing barriers are conventionally designed to withstand the pressures at the lower end depth of casing placement, typically referred to as the "casing shoe." When a secondary deep casing barrier fails and deeper subterranean pressures are placed within the surrounding annulus pressure void, the shallower and lower pressure resistant tertiary casing barriers may have insufficient pressure bearing capacity for said deeper pressure communication and may also fail, and so on and so forth, until the final barrier fails and an unplanned release of fluid from a well occurs.

Furthermore, fishing operations for heavy workover units and drilling rigs are particularly difficult and dangerous within a pressurized environment resulting from such failures, where fishing equipment must be snubbed into a well through the blowout preventer while damaged equipment is stripped out of the well through blowout preventers. The blowout preventers must be opened and closed around the varying diameter of tools joints and pipe bodies for each joint snubbed in or stripped out, wherein the design of the blowout preventers requires a circular circumference and, hence, cannot not seal against the deformed conduit circumferences.

Within explosive hydrocarbon environments, where repeated wear and tear from snubbing and stripping operations may weaken the sealing capacity of blowout preventers, unintended hydrocarbon leakage may occur. Snubbing and stripping operations are considered extremely risky operations by industry, wherein snubbing and stripping practitioners are considered to be the highest risk tolerance workers within the industry, purportedly out of necessity rather than choice.

Since the failure of various well components, like casings, liners and the surrounding sealing cement can provide leak paths, which are not necessarily accessible to kill fluids during a well kill operation or stoppable by the wellhead or blowout preventers, and the pressures exerted during a kill operation may aggravate said leak paths, the failure of downhole conduits poses a serious risk. Additionally, since snubbing and stripping blowout preventers are engaged to the existing wellhead and/or Xmas tree, they may not provide the necessary blow out protection in instances where well casings have failed beneath the wellhead.

Accordingly, a need exists for methods and apparatus usable with coiled string operations that can re-establish access or passage to the lower end of a well through the debris and/or damaged walls of an intermediate well conduit failure to provide access for isolating production from damaged well equipment sections, and using, e.g., the apparatus and method of GB1111482.4, prior to repairing a damaged section or abandoning the damaged section of a well. Coiled string operations can be more easily and safely carried out through pressure controlled equipment, without adversely affecting or further damaging subterranean well equipment, with the pressures exerted by, e.g., a heavy well kill fluid. The conventional need for expensive and potentially more dangerous fishing and milling operations, using a hydraulic workover unit or drilling rig, may not be necessary.

Additionally, a need exists for apparatus and methods that can use explosives axially within a well and can absorb axial fluid pressure shocks or fluid hammer effects upon well equipment when using focused explosives. A further need exists for focusing an axial fluid shock or fluid hammer effect, in a selectively oriented direction, to aid in re-establishing access to the lower end of the well through intermediately damaged well bore walls.

Well component failure can also occur as a result of operational wear from using a well, particularly with regard to thermal and operation cycling when producing and shutting in production. Since subterranean strata generally gets hotter with depth, due to the heat radiated from the earth's molten mantle core, produced fluids can carry that heat from the strata and cause components of a well to expand with production and contract when production is stopped as shallower, lower temperature strata, less affected by the molten mantle core, cool the various portions of the completion. The cycling of production and production shut-in causes associated expansion, contraction, pressure ballooning and/or movement of well components that may repeatedly stress and/or erode said components to the point of failure.

Conventionally, movement of the production conduit strings, which are placed within cemented-in-place liners and casings, is facilitated by applying tension during the installation of said production conduit strings to reduce physical movement and associated wear, at the expense of placing additional stresses upon components, which may be aggravated by thermal expansion and contraction.

Various conventional provisions are available for allowing movement of components, such as expansion joints to absorb movement, which may use seal stack mandrels at the lower end of the production conduit string, within a polished bore receptacle (PBR) that can be engaged to a liner top packer or production packer secured to said casings, wherein an expansion joint can reduce the stresses associated with thermal expansion and contraction, but increases physical movement and associated wear and tear on moving completion components during cycling of production and production shut-in.

Accordingly, the well completion may comprise a simple tubing string within a casing with a valve tree at its upper end and a production packer at its lower end, with tensioned tubing between, or it may have, e.g., subsurface safety valves and associated control lines, sliding side doors for opening and closing a passageway between the production conduit and intermediate annulus, PBR's, seal stack mandrels, jet pumps, hydraulic pumps, rods, side pocket mandrels for associated gas lift valves, and/or various other completion components, each of which may fail with operational stresses, wherein movement of the completion and/or movement within the surrounding strata can damage the well bore's walls, thereby making the piloting of a tool string through failed components conventionally difficult.

Over the life of a well, the well components and well production casing or liners and conduits may be adversely affected by: chemically corrosive fluids; solids and fluids erosion; subterranean temperatures and/or pressures causing flexure, expansion and/or contraction; vibration, wear or frictional deformation from interaction between various downhole well completion components or from drill strings, wireline, coiled tubing or other tools operating on or adjacent to well components; as well as plastic deformation caused by strata shearing, thrusting or subsidence movement from, e.g., movement of mobile subterranean salt formation or overlaying pressurized overburden strata forces on produced and depleted formations, which can cause slumping or shifting and/or movements of strata due to hydration or lubrication of shale, clays or other strata within the overburden due to water ingress from natural or induced faults, fractures, water floods and/or faulty well cement isolation from water bearing formations, water floods or natural water drives.

Various adverse conditions can render a well inoperable from a pressure and fluid integrity perspective and/or prevent deployment of downhole apparatuses necessary to, for example, repair the effected portions of a well, suspend portions of a well for later repair, abandon portions of a well that cannot be repaired, and/or side-track portions of a well to provide further production.

A need exists for accessing various portions of a well through differing types of debris and damage using less intrusive coiled string operations through an existing pressure control envelope to provide access through a damaged portion, which can be for other coiled strings used to repair or abandon a section or isolate pressures from a damaged portion to provide safer operations than, e.g., jointed pipe stripping and snubbing operations.

As casing and/or liners are, generally, cemented within the strata, even minor movements of the strata, around conduit casings and liners, may cause said conduits to become oval in shape while more severe movement can collapse or shear said conduits. Rupture of various components within a well may also expose other components to subterranean pressures for which they were not designed. For example, if a secondary conduit barrier, such as the production casing, is leaking from wear caused by movement of the tubing and the tubing then ruptures, pressure could be placed on the intermediate and surface casings, which could cause them to burst and release fluids to the environment.

Attempting to fish or mill damaged components that are not axially aligned with the centre of a well bore can lead to inadvertent side-tracking of a well, wherein access to the original and damaged well bore may be lost and which can potentially cause a serious pressure control situation, as pressures continue to leak through the damaged portion, which may no longer be accessible as a result of the incidental side-tracking.

A need exists for methods and apparatus usable to traverse axially obstructive discontinuous portions through an intermediate well bore failure without side-tracking the well during repairs and/or accessing a proximally axial contiguous passageway, so as to access and isolate pressures from said failure at their source.

Temperature cycling from, for example, repeatedly starting and stopping production can adversely affect a completion, casing and/or liner components, while significant temperature increases in a confined annulus can cause significant pressure and may plastically collapse or burst well components. Component failures from, for example, a tubing leak at the upper end of a tubing string may not burst the production casing, but may increase the pressure within the annulus sufficiently enough to collapse the tubing at the lower end of the well, when combined with the hydrostatic pressure of the fluid within the annulus.

A need exists for apparatus and methods usable for less intrusive coiled string interventions, which are capable of, for example, providing a passageway through a tubing collapse and then repairing said tubing collapse with, for example, an expandable metal patch, to allow, e.g., bullhead killing of a pressurized reservoir through the repaired production tubing.

Alternatively, the build-up of scale within tubing over the life of a well can be significant and may choke off production significantly. A need exists for tools capable of engaging and cleaning scale debris from a production casing to provide an access passageway through the tubing to, for example, set plugs within nipples, clean downhole valves, side-pocket mandrels and/or inject or use a wireline dump bailer to place chemicals to further clear scale from various downhole well components.

Accordingly, over the productive life of a well, many factors may adversely affect the components of the well and prematurely end the useful life of a portion of the well, the entire well or its economic life, whereby the suspension, abandonment and/or side-tracking of all or a portion of the well is necessary but impractical with conventional means.

A need exists for a more cost effective means of providing access to a well portion clogged by debris or that has been damaged.

Passage of both fluids and tooling within a well may be adversely affected by, e.g., debris within a bore from sand production from a reservoir, or shale production from a flow cut conduit or scale from production, or the passage may be adversely affected by deformation of conduits by movement of the surrounding strata, differential pressures across conduits and/or wear and tear from operation of the well.

A need exists for apparatus and methods usable for coiled string compatible passage of downhole apparatuses and fluids through the proximally circular and deformed circumferences of a well bore.

The need for fluid or tool communication is particularly acute during the suspension, side-tracking and/or abandonment of a well bore, because subterranean pressures within a bore must be sealed from depleted formations and the surface environment. The prevention of fluid communication and/or loss of fluids, from a deposit into other depleted and/or permeable formations or strata factures and/or the protection of a reservoir deposit or production stream from, e.g., water ingress, is important to our economy.

A need exists to access passageways below an intermediate well bore failure without removing surface well barrier pressure control envelopes to reduce the risk of unplanned releases of well fluids that endanger the surface environment, endanger sensitive strata formations, e.g., ground water horizons, and waste presently unrecoverable subterranean deposits that may be recoverable later by, e.g., using technology that has not yet been invented.

Various aspects of the present invention address these needs.

SUMMARY

Accordingly, preferred embodiments of the present invention provide methods (1, 1A-1AE) and apparatus (2, 2A-2AE) for using a tool string (8, 8A-8AE) and at least one downhole device (3, 3A-3AE) with a circumferential adaptable apparatus (2) to urge access or passage through an obstructive dissimilar contiguous passageway (9) of a subterranean well bore (10), which can be formed by frictionally obstructive debris (18) within or at least a partially restricted circular or deformed circumference thereof.

Embodiments of the present invention include the use of at least one circumferential adaptable apparatus (2) and an associated axial pivotal member (7, 7A-7AE) that can be flexibly hinged to at least one shaft segment of a plurality of movable shaft segments (6, 6A-6AE), which can be interoperable with the at least one circumferential adaptable apparatus (2) and the at least one downhole device (3). Embodiments can be usable to operate a tool string comprising a deployment string (8) with a lower end coiled string compatible connector (17) engaged to an upper end shaft segment of a plurality of movable shaft segments that are interoperable with the at least one circumferential adaptable apparatus (2) and the at least one downhole device (3). Tool string embodiments (8A-8AE) can be deployed in and placed or removed through an upper end of the subterranean wellbore (10) and into or out of a lower end of the wellbore (10), to urge access or passage through the obstructive dissimilar contiguous passageways (9), which comprises a first (4, 4A-4AE) and at least a second (5, 5A-5AE) wall portion comprising an obstruction formed by at least one of: an obstructive partially restricted circular or deformed circumference, frictionally obstructive walls, or frictionally obstructive debris (18) therein.

Embodiments of the present invention can provide interoperability between a tool string's (8) tools, which can comprise axially orienting shafts and members or member parts of said tools, relative to an obstructive dissimilar contiguous passageway (9), by using an engagement of the at least one circumferential adaptable apparatus (2) with the walls of the dissimilar contiguous passageway (9) to selectively orient the tool string (8) and traverse a pilotable passageway therebetween, or to deform a wall portion thereof to form a pilotable passageway through said obstructive dissimilar contiguous passageway (9). Interoperability between the tools deployed by the tool string (8) can be usable to urge access or passage of the tool string (8) through frictionally obstructive debris within, or an at least partially restricted circular or deformed circumference of wall portions (4, 5) that can form the obstructive dissimilar contiguous passageway (9) of a wellbore (10) at its lower end.

Various related embodiments can include a downhole actuation device, wherein said interoperability can comprise using tension of said deployment string (8) and/or at least one actuating type downhole device (3) to operate or orient other tools of the tool string or member parts.

Various other related embodiments can use at least a second actuation downhole device (e.g. 3, 11, 23) to operate a tool string by disposing and selectively orienting: at least one downhole device (3), at least one axial pivotal member (7), at least one shaft segment, or at least a second shaft segment of said plurality of movable shaft segments and/or the deployment string (8) to selectively dispose the tools of the tool string, radially and/or axially, to selectively orient the tool string within an obstructive dissimilar contiguous passageway (9) and wellbore (10).

Various other embodiments can be usable with a circumferential adaptable apparatus (2) having a fluid passageway (24) and/or orifice (28) that can selectively control fluid communicated within the well bore (10) and/or operate the tool string.

Other embodiments can comprise a circumferential adaptable apparatus (2) with a valve (e.g. 11, 11A1, 11T, 11U) and/or permeable membrane (e.g. 27, 27T) which can be used to selectively control fluid communicated within the well bore (10) and/or for operation of the tool string.

Still other embodiments can use an actuating downhole device with a positive fluid displacement valve (e.g. 11A, 11U) and/or momentum vibrator (12, 12A, 12U), which can be usable to move and/or reorient and operate a tool string to improve the urging of access and passage through frictionally obstructive passageways.

Various embodiments can use an actuating downhole device (3) that can comprise a hydraulic, electric and/or explosive downhole device.

Related embodiments can use explosive perforating (20, 20I, 20J, 20M) and/or explosive sculpting (19, 19I, 19J, 19M1, 19M2) downhole devices (e.g. 3E, 3F), which can be operable upon at least part of an obstructive dissimilar contiguous passageway (9).

Other related embodiments (e.g. 1G-1K, 1M, 1W, 1Y) can comprise focusing, and/or absorbing hydraulic energy and/or explosive energy using an axial pivotal member (7), which can operate a tool string when further deforming at least part of an obstructive dissimilar contiguous passageway's walls (9) to provide further access or passage.

Various embodiments can use a motor actuating downhole device (3) which can use electrical or hydraulic energy (e.g. 21, 21L1, 21L2, 21L3).

Related embodiments can use an actuating downhole device and/or a circumferential adaptable apparatus (2), comprising a plurality of movable shafts with: a helical nodal rotor shaft (e.g. 6A2, 6U2) within an associated helical nodal stator (e.g. 6A3, 3AE1, 3AE2) housing shaft, or an inner shaft within an encompassing outer housing shaft with opposing turbine blades (62) on one or more of the inner or outer encompassing shafts, wherein one shaft can rotate relative to the another shaft via a differential fluid pressure applied to said helical nodes or turbine blades, which can be used to communicate fluids and operate the tool string.

Various embodiments can selectively urge the expansion or collapse of an axial pivotal member (7) using an actuating downhole device to dispose at least a second shaft segment relative to the engagement of a flexible hinge to a shaft segment, wherein the expansion or collapse of an axial pivotal member (7) controls its effective diameter and operates, orients, engages or disengages the apparatus and associated tool string to or from at least part of a dissimilar contiguous passageway's walls (9).

Various embodiments can comprise functionally shaped: controllably deformable material (e.g. 2A, 3D2, 22P, 15Q, 15R, 15T, 15U, 22O, 30, 30O) and/or substantially rigid material (e.g. 14S, 15D, 26T1-26T2, 26AA-26AC, 29, 29T), which can be used to selectively operate an apparatus and tool string.

Other embodiments can use an axial pivotal member (e.g. 7N, 7P, 7Q, 7R, 7T1-7T3) comprising a packer (34, 34A, 34U, 34AE), bridge plug (e.g. 35, 35A, 35U, 35Y1-35Y2), pedal basket (e.g. 22, 22N, 22O, 22P, 22T1-22T2) and/or flexible membrane (e.g. 15, 15A, 15Q, 15R, 15T, 15U).

Various related embodiments can use an axial pivotal member (7) with at least one mechanical arm linkage (e.g. 14B, 14C, 14Q, 14S, 14T1-14T5, 14AE1-14AE4) and/or a wheeled mechanical linkage (e.g., 26T1-26T2, 26AC, 26AB1-26AB2, 26AA, 26AE1-26AE2) to further operate and selectively orient a tool string.

Still other embodiments can include the use of the tool string apparatus and downhole devices to forcibly deform an obstruction within a dissimilar contiguous passageway (9), radially outward and/or axially downward to, in use, urge access or passage between the circumferences forming the obstruction.

Various related embodiments can comprise operating a cutting downhole device (3E, 3G, 3L1, 3AE) on at least one shaft segment (6) of a plurality of shaft segments and/or an axial pivotal component member (7) to forcibly deform at least a part of an obstruction within a dissimilar contiguous passageway (9) to pass or traverse the obstruction.

Other related embodiments can include the use of a mechanical cutter (13), chemical cutter and/or explosive cutter downhole device (3), which can deform obstructive walls (9) and can be used to provide access or passage therethrough.

Still other embodiments can operate a wedging downhole device (e.g. 37, 37A, 37J,) which can be used on a detachable shaft segment and/or as part of an axial pivotal component member (7), which can be used to deform obstructive debris preventing access or passage through wall portions (4,5) using differential fluid pressure applied across a wedge.

Various embodiments can use at least two shaft segments with an intermediate spring like joint (e.g. 23, 23A, 23T1-23T4, 23AE1-23AE2), knuckle joint (e.g. 16, 16C, 16E, 15V), hinged joint (e.g. 25, 25O, 25Q, 25T1-25T13, 25AC1-25AC2, 25AB1-25AB2, 25AA1-25AA2, 25AE1-25AE4) and/or ball joint, which can be used to operate and selectively orient, or pilot, an apparatus tool string.

Various embodiments can use at least a second shaft segment which can be axially movable within another encompassing shaft segment, while other embodiments can use a plurality of movable shaft segments which can further comprise a substantially flexible shaft (e.g. 6B2, 6E1) and/or a substantially rigid shaft (e.g. 6B1, 6E2-6E3, 6T1-6T10, 6T1-6T10, 6AE1-6AE11, 6C1-6C2, 15D) that can be used to further operate an apparatus tool string.

Other embodiments can use substantially rotating (e.g. 6B2, 6C2, 6E1, 6L1, 6L5-6L6) and/or substantially stationary (e.g. 6A, 6B1, 6C1, 6D, 6E2-6E3, 6L2-6L4, 6L7, 17L7) shaft segments that can be usable to further operate (e.g. 1A-1E, 1G) an apparatus tool string.

Various other embodiments can use dogs, slips, shear pins and/or mandrels as a holding downhole device (3), which can be used within an associated receptacle to selectively engage movable shaft segments.

Various embodiments can comprise an arrangement of shafts (6) and axial pivotal components (7) that can form a hole finding tool (e.g. 2A-2C, 2E-2F, 3Z) or can carry a hole finder downhole device (3), which can be usable to locate an accessible or pilotable passageway to access or traverse through or past an obstruction within a dissimilar contiguous passageway (9).

Various methods and apparatus of the present invention can be usable to operate an image logging downhole device (3) that can be incorporated into or can be selectively oriented by a circumferential adaptable apparatus (2) to, in use, image the obstruction within the dissimilar contiguous passageway (9), which can be used for further selective arrangement and orientation of tool strings that can be used to traverse pilotable passageways and/or can be used to selectively deform obstructive passageways to make them pilotable, by using the empirical imaging data from said logging downhole device. In an embodiment, the tool string can be used to pilot a lining into an obstruction, within a dissimilar contiguous passageway (9), to form a pilotable passageway for access or passage.

BRIEF DESCRIPTION OF THE DRAWINGS

Preferred embodiments of the invention are described below by way of example only, with reference to the accompanying drawings, in which:

FIGS. 1 to 3 depict prior art diagrams and a graph of a slickline cement retainer's deployment and usable diameters of conventional inflatable packer downhole devices.

FIGS. 4 and 5 illustrate an embodiment of a wireline, coiled string or jointed pipe tool string embodiment for access or passage through horizontal or inclined subterranean well bore dissimilar contiguous passageway walls, wherein removal of the debris is not necessary.

FIG. 6 depicts a prior art flexible shaft and boring bit, while FIGS. 7 to 21 depict wireline, coiled string or jointed pipe tool string embodiments usable for access or passage through subterranean well bore dissimilar contiguous passageway walls.

FIGS. 25 to 27 depict rotary cable operations apparatuses usable with the present invention, wherein FIG. 26 shows an embodiment usable with said rotary cable tools.

FIGS. 28 to 34 illustrate various parts of axial pivotal member embodiments usable to form circumferential engagement apparatuses of the present invention.

FIGS. 35 to 44 depict an embodiment of the present invention illustrating a substantial expanded to deployment diameter ratio.

FIGS. 54 to 59 depict various tool string embodiments of the present invention usable for access or passage through subterranean well bore dissimilar contiguous passageway walls.

FIGS. 60 to 67 show an embodiment of the present invention usable for access or passage through subterranean well bore dissimilar contiguous passageway walls as a hydrodynamic fluid bearing cutting tool string.

Embodiments of the present invention are described below with reference to the listed Figures.

DETAILED DESCRIPTION OF THE EMBODIMENTS

Before explaining selected embodiments of the present invention in detail, it is to be understood that the present invention is not limited to the particular embodiments described herein and that the present invention can be practiced or carried out in various ways.

Figure 50:
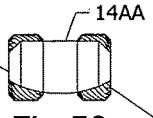
Figure 51:
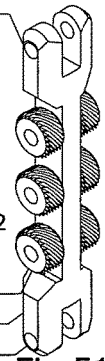

It is to be understood that the various method (1) embodiments (1A-1AE) using a circumferential adaptable apparatus (2) embodiments (2A-2AE) explained within: (A) of FIGS. 4 to 5, (B) of FIG. 12, (C) of FIG. 13, (D) of FIG. 14, (E) of FIG. 7, (F) and (G) of FIG. 8, (H) of FIGS. 15 to 17, (I) of FIGS. 18 to 19, (J) of FIG. 20, (K) of FIG. 21, (L) of FIGS. 25 to 27, (M) of FIG. 24, (N) of FIGS. 31 to 32, (O) of FIG. 28, (P) of FIG. 30, (Q) of FIG. 34, (R) of FIG. 33, (S) of FIG. 29, (T) of FIGS. 35 to 44, (U) of FIG. 58, (V) of FIG. 56, (W) of FIG. 55, (X) of FIG. 45, (Y) of FIG. 54, (Z) of FIG. 59, (AA) of FIGS. 50 to 51, (AB) of FIGS. 48 to 49, (AC) of FIGS. 46 to 47, (AD) of FIG. 57, and (AE) of FIGS. 60 to 67, can be usable to pilot any downhole devices of the present inventor or any conventional downhole devices (3, 3A-3Z) deployed at the lower end of a string (8), which comprises, e.g., slickline, electric line, coiled tubing or jointed pipe using a coiled string compatible connector (17), in which the described arrangement and assembly of tools at the lower end of the connector (17) can comprise tool string embodiments (8A-8AE) with interoperability between tools being usable to urge access or passage through an obstructed dissimilar contiguous passageway or walls of a dissimilar contiguous passageway (9) of a subterranean well bore (10).

Referring now to FIG. 1, an elevation view of a prior art pedal basket (67) cement retainer (66) is illustrated in various deployment stages (72-75), which is representative of most related slickline prior art dealing primarily with the securing of tools and/or dumping, bailing or removing debris with a bailer. In addition, other prior art uses include placing small tools through a circular and relatively constant diameter well bore, albeit various nipple no-gos and planned restrictions or, for example, through the circular circumferences of a tubing tail pipe (76) into the production liner or casing (77) of significantly different diameter, as well as anchoring of tools (68) within the tubing (76), liner or casing (77).

In the illustrated example of a prior art deployment of a pedal basket, the cement retainer (66) is first deployed (72) in a collapsed state to a point below the tail pipe (76), shown as a dashed line, where the upper actuator (3, 69) is used to actuate the slips (68) anchoring the retainer (66) to the casing (77), shown as a dashed line, in the second phase (73). The third phase of deployment (74) uses the second downhole actuating device (3, 70) to actuate the pedal basket (22) within the casing (77), wherein substantially different diameters (4, 5) exist between the casing and tailpipe, which may prevent retrieval of the basket once actuated. The final phase of deployment (75) is to remove the upper actuator (70) and encompassing shaft leaving the internal central shaft (71), used to actuate the slips (68) and pedal basket (22) within by the actuating axially movable shafts along its length, using the downhole actuators (69, 70).

Numerous conventional actuating downhole devices are usable to perform these common actuation tasks within various embodiments of the present invention, wherein the cited references provide various modifications to this conventional practice dating to the 1940's.

While prior art is not completely incapable of traversing substantially differing circumferences formed between the tubing (5, 76) and casing (4, 77) or open hole (79 of FIG. 2), it is important to emphasise that conventional technology presumes that the tubing and casing are not, e.g., clogged with debris or scale or crushed or collapsed, and wherein circular circumferences provide relatively low friction factors and whereby, e.g., a wireline entry guide is generally used at the lower end of a tailpipe (76) protruding within a casing (77) bore to aid traversing the differing diameters. Hence, while both the present invention and prior art are suited for a tail pipe, the present invention provides significant benefit by, for example, not requiring a wireline entry guide or circular circumferences, wherein the present invention provides access or passage past debris within wellbore walls, which prior art does not disclose and cannot provide.

FIGS. 2 and 3 show a diagrammatic elevation cross sectional view through a subterranean wellbore of a prior art coiled string deployable inflatable packer or bridge plug, and a chart showing the expansion capabilities of conventional inflatable packers and bridge plugs, respectively. As shown in the FIG. 3 chart, reproduced from the cited brochure of an industry leader in the art of inflatable technology, TAM International Inc., the deployment diameter of a conventional inflatable membrane packer is 95.25 millimeters (mm) or 3.75 inches (") if it is desired to inflate the packer to engage the sides of a 244.5 mm (9⅝") casing with an inside diameter of approximately 215.9 mm (8.5 inches), which is the average wall thickness of a North Sea production casing. The deployment diameter of an element (labelled "el." in FIG. 3) of 95.25 mm or 3.75 inches (labelled " in FIG. 3), may be acceptable for a 114.3 mm (4½ inch) outside diameter tubing weighing (18.8 kilograms (kg) per meter (m) or 12.6 pounds per foot with a drift diameter of 97.4 mm (3.833 inches), but it will not fit through a heavier wall 114.3 mm (4½ inch) outside diameter tubing or a smaller diameter API tubing and still engage or hold within the walls of said 244.5 mm (9⅝") casing. Generally, this is not a significant issue because the primary purpose, as demonstrated by the chart, is to hold differential pressure, wherein said 94.25 mm (3.75 inch) deployment diameter inflatable packer is capable of holding between 206.9 and 275.8 bar (3,000 and 4,000 pounds per square inch, respectively) differential pressure. An inflatable packer capable of passing through the 55 mm (2.165 inch) drift diameter of API 73 mm (2.875 inch) outside diameter tubing, weighing 12.6 kg/m (8.44 pound per foot), could have a deployment diameter of 54 mm (2.125 inches) with a maximum expandable conduit circumference engagement diameter of between 152.4 mm (6 inches) and 177.8 mm (7 inches), according to said leading manufacturer's chart.

Accordingly, as shown in FIG. 2, if a conventional inflatable packer (78) is capable of being deployed on a string (8) through the 54 mm (2.165 inch) inside drift diameter of 73 mm (2⅞ inch) outside diameter tubing (76), into a 215.9 mm (8.5 inch) inside diameter casing (77) that is cemented (80) within an open strata bore (79), generally sized to a minimum of 311.2 mm (12¼ inch) inside diameter, and referred to as "open hole," then said conventional packer is not capable of either engaging the casing or the open hole with the slip segments (82) secured to its membrane (81) at its maximum inflation.

Referring now to FIGS. 4 and 5, the Figures depict a diagrammatic elevation cross section along a horizontal well bore (10), with line A-A associated with the FIG. 5 cross section through line A-A of FIG. 4 transverse to the well bore axis. The Figures illustrate embodiments (1A, 2A) of a method (1) and apparatus (2) for access or passage through obstructions within the dissimilar contiguous passageways (9) or through walls of the obstructive dissimilar contiguous passageways (9) using a tool string (8) embodiment (8A) and downhole device (3), which are usable when, e.g., removal of debris is not necessary.

Traversing and/or plugging an embodiment (10A) of a horizontal well bore (10) without debris removal may be necessary during, e.g., abandonment operations to support a cement like settable sealing material and prevent the heavier cement-like fluid from channelling on the lower end of the horizontal wellbore while lighter downhole fluid channels along the upper portion of the wellbore and contaminates the cement-like material to weaken it, thus preventing its setting and/or sealing for said abandonment.

The tool string (8) may be traversed through a pilotable passage between wall portions (4) of open hole (4A), dissimilar to another open hole (5A) wall portion (5), and further complicated by debris (18) therein forming, in amalgamation with the wellbore (9A), the walls of the obstructive dissimilar contiguous passageways (9) of a well bore (10). The tool string embodiment (8A) may comprise, e.g., slickline, electric line, coiled tubing or jointed pipe with a lower end coiled string compatible connector (17) engaged to circumferentially adaptable apparatus (2A) comprising a plurality of shaft segments (6) and member parts. Shaft segment embodiments (6A1-6A3) may comprise an encompassing shaft (6A1) with rotor (6A2) and stator (6A3) shafts, usable as a momentum vibrator (12), and positive displacement valve (11) embodiments (12A and 11A, respectively) with orifices (28) for fluid intake (32) and exhaust (33) from the vibrator and valve, with a spring like joint (23) embodiment (23A) interoperable with an axial pivotal member (7) part embodiment (7A) comprising a downhole device (3) embodiment (3A), and further comprising an inflatable membrane (15) embodiment (15A).

The tool string (8A) may be urged, using surface applied fluid pressure (31) against the inflatable membrane (15), through the substantially differing diameters of the open hole (9A) from, e.g., a near vertical to near horizontal inclination using differential pressure across axial pivotal downhole device member part embodiments (34A, 35A) further comprising a packer (34) or bridge plug (35), when urged to a desired disposition along the wellbore (10), wherein a fluid passageway (24) embodiment (24A), formed by the positive displacement valve (11A) cavity between, e.g., a helical rotor (6A2) and stator (6A3) is fluidly routed between the left and right orifices (28) to use the difference between surface (31) and bottom hole pressure (32) to actuate the positive displacement valve (11A), which is fluidly exhausted (33) past the packer with axial movement of the string (8A).

The passageway (24A) may be selectively and fluidly connected via, e.g., a pressure activated valve, to fill and deplete the fluid filled deformable material membrane (15) for selectively exhausting the fluid to collapse said membrane (15A), when piloting a restricted effective diameter of the walls of the obstructive dissimilar contiguous passageways (9A), and to intake fluid to expand said membrane when said effective diameter increases, using said positive displacement valve interoperability between the plurality of shaft segments and differential pressures between applied surface pressure (31) and bottom hole pressure (32) across the packer (34).

FIG. 6 depicts a diagrammatic elevation view of a prior art boring bit (13) and the flexibility of its combined flexible and rigid shaft (36), which can be usable within any embodiment of the present invention as a downhole device (3) member of an adaptable apparatus (2) and/or hole finder. Various other flexible shaft arrangements, described in published application GB2484166A of the present inventor, can be combined with the methods and apparatus of the present invention.

Referring now to FIGS. 7 and 8, the Figures illustrate a diagrammatic elevation view of a slice along the axis and a diagrammatic plan cross sectional view transverse to the axis along the walls of dissimilar contiguous passageways (9E, 9F1, 9F2) of two subterranean wellbores (10), respectively. The Figures show method (1) embodiments (1E, 1F, 1G) and apparatus (2) embodiments (2E, 2F, 2G) that can be usable with tool string (8) embodiments (8E, 8F, 8G) and a downhole device (3), which can be usable to access or provide passage through, e.g., collapsed wellbore walls resulting from strata movement (38) and/or wall portions with scale debris from production.

A string (8), comprising a coiled string, but usable with, e.g., jointed pipe or jointed shaft segments of a tool string, may form part of the tool strings (8E-8G), which can include circumferential boring or expandable wedging (37) members of adaptable apparatus (2) and/or downhole devices (3E-3G), which can comprise any mechanical cutting tool (13), e.g. a rotary drill bit for metal and/or rock, wedging downhole device (37) or axial displacement wedge, that can be engagable with or forming a member of a circumferential adaptable apparatus (2E-2G), which can include a plurality of movable shaft segments (6) and an axial pivotal member (7). A flexible shaft (36, 6E1) can be usable, when oriented by an axial pivotal member (7), to selectively pilot between wall portions (4E and 5E, 4G and 5G, 4F1-4F3 and 5F1, 4F4-4F6 and 5F2, 4F7-4F9 and 5F3) of substantially differing effective diameters, thus forming dissimilar contiguous passageway walls (9), within a well bore (10). An arrangement of a plurality of shafts (6), comprising a flexible shaft (6E1), may be rotated or extended and retracted within or through encompassing housing shafts (6E2, 6E3) with an intermediate flexible (16) knuckle or ball joint (16E), which can be selectively alignable with an axial pivotal member (7, 7E) to pilot and traverse a tortuous path through, e.g., a collapsed subterranean wellbore. A series of various proximally axially contiguous pilotable passages (4F1-4F3, 4F4-4F6, 4F7-4F9) may be accessed and deformed to a larger effective diameter to provide passage through wall portions (5F1, 5F2, 5F3, respectively) to allow a still larger deformation of a wall portion (4F) to wall portion (5F), to provide an enlarged passageway for tool passage using boring (13, 3F) and/or wedging (37, 3G) downhole devices (3) and/or axial pivotal displacement members (7) of a circumferential adaptable apparatus (2).

FIGS. 9 and 10 depict diagrammatic isometric views of wellbore (10) walls (9) before and after being deformed by subterranean strata movement (38), respectively, while FIG. 11 shows a diagrammatic isometric view of a prior art approach to gaining access or passage to the FIG. 10 well, which has resulted in a side-track of the subterranean wellbore (10) due to the walls of its dissimilar contiguous passageways (9). The wellbore (10) walls (9) comprise, e.g., casing (9B2) and production tubing (9B1) that are deformed by moving strata forces (38) forming substantially differing circumferences (4B, 5B), which can cause the tubing to become conventionally unusable and effectively debris (18) within the wellbore.

Side-tracking of a damaged portion of a wellbore without first abandoning the lower section of a wellbore (10), which is fluidly connected with a reservoir, is particularly risky because once the side-track has occurred, it is virtually impossible to re-enter the original dissimilar contiguous passageway since an axially deployed string always favours the axially aligned side-track; however, fluid from the reservoir is free to follow through any passageway not restricted by fluid capillary friction. Hence, the reservoir cannot be effectively abandoned because the heavier and more viscous kill weight mud and/or cement like fluids cannot be injected through the same pore or passageway spaces and/or can become contaminated from percolation of buoyant lighter and more fluid reservoir gases and liquids axially upward.

Killing of an intermediately collapsed wellbore is difficult because reservoir fluid may continue to percolate through various permeable pore spaces or strata fractures that are not fillable with kill weight fluid, typically referred to as kill weight mud due to its composition and consistency. Hence, it may not be possible to kill the well with heavy mud to allow replacement of the surface valve tree with a blowout preventer. Accordingly, conventionally high risk snubbing and stripping operations may be necessary when a well cannot be killed effectively and conventional hydraulic workover units and/or a drilling rig may be needed.

The boring capabilities of conventional boring arrangements (39), e.g. coiled tubing arrangements and/or rotary cable tools of the present inventor (GB2471760), without the piloting capabilities of a circumferential adaptable apparatus (2), may be unsuited for accessing and providing a passageway to allow abandonment of the damaged well. This is due to their propensity to deflect off of the substantially differing effective circumferences of deformed wall portions (4, 5) and to side-track the well, thus losing access to the lower fluid reservoir fluid connection of the well.

Referring now to FIGS. 12 to 14, these figures show diagrammatic isometric views of the wellbore (10) walls (9) of FIG. 10 and illustrate method (1) embodiments (1B, 1C, 1D) and apparatus (2) embodiments (2B, 2C, 2D), which can be usable with a tool string (8) embodiments (8B, 8C, 8D) and a downhole device (3) to provide access or passage through the walls of dissimilar contiguous passageways (9B1 and 9B2, 9C1 and 9C2, 9D1 and 9D2). Flexible shaft arrangements can be used to gradually increase the effective diameter, and can progress to more rigid shaft arrangements to proximally align the upper end of the wellbore with the lower end, so as to install an intermediate conduit, e.g. an expanded flexible metal pipe encompassing shaft (15D) about an expander downhole device (3D1) at the lower end of an expander shaft (6D), to provide a more pilotable passageway for deployment strings to traverse.

A tool (8B, 8C) string (8) can comprise, e.g. slickline or other coiled string, for deploying a circumferential adaptable apparatus (2B, 2C) with a plurality of shafts (6) that can be usable with a flexible rotatable shaft (6B2, 6C2) jointed (16B, 16C) linkage (14B, 14C) and a lower end mechanical cutter (13), e.g. a rotary boring bit, with an upper end, e.g., positive fluid displacement motor rotary cable tool of the present inventor, and an electric or coiled tubing motor that comprises a substantially rigid shaft (6B1, 6C1), which can be held substantially stationary by an axial pivotal member (7B, 7C), comprising, e.g., 7T1 and 7T3 of FIGS. 35 to 44, 14AA-14AC of FIGS. 46 to 51 and 7AE1-7AE2 of FIGS. 60-66, which is usable to further deform and provide access or passage through the walls of the dissimilar contiguous passageways, through deformation of the wall portions (4B and 5B, 4C and 5C, 4D and 5D) of substantially differing circumferences. Various mechanical cutters (13), e.g. the boring cutter (13) of FIGS. 6 to 8, may be used with the tool string (8), or the abrasive lateral cutters (13AE) of FIGS. 60 to 67, or wedging (3B, 3C), explosive (3M1-3M3) and/or sculpting (19M1-19M3) downhole devices (3) or axial pivotal members may be used and oriented with the tool string (8). Once access or passage has been provided, it may be improved by, e.g., engaging a straddle conduit to reconnect the tubing (9B1) or expandable conduit (15D) by using an adaptable apparatus (2D) to place and orient a wedging downhole device (3D2) via the axial pivotal member part (7D) to wedge the expandable conduit radially outward with an expander (3D1) and further deform debris from, e.g., boring to further improve access and passage through frictionally obstructive debris (18).

FIGS. 15 to 21 illustrate the proportions of a collapsed 15.2 cm (6⅝") conduit with a 2.5 cm (1 inch) wall thickness made of very hard 861,845 kPa (125,000 psi) yield strength material. As shown, the wells are in fluid connection with a reservoir and are losing access to the lower end of a wellbore due to collapse of the bore, wherein side-tracking is a major risk.

Figure 15:
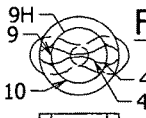
Figure 16:
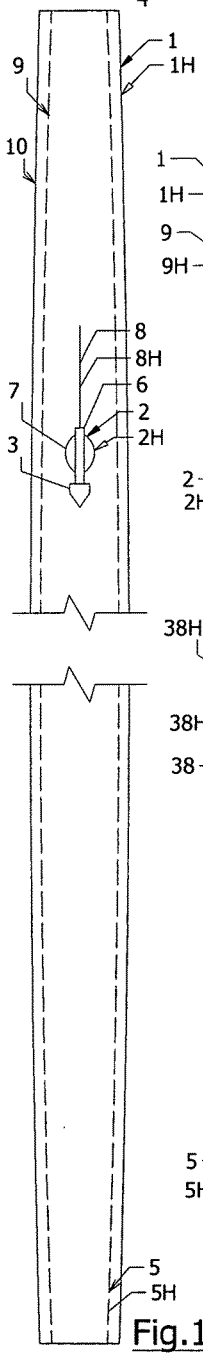
Figure 17:
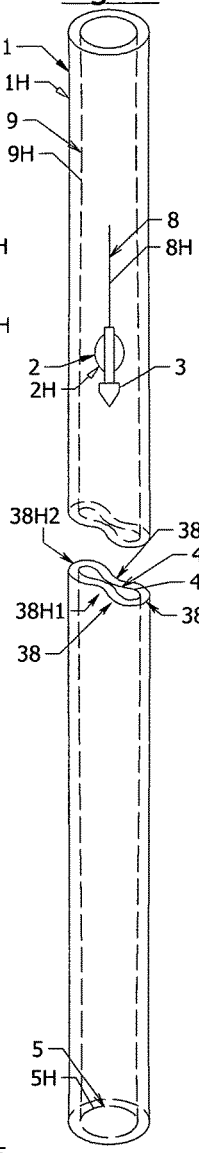

FIGS. 15, 16 and 17 illustrate a plan view, where FIG. 16 depicts an elevation view with break lines, and FIG. 17 depicts an isometric view with the FIG. 16 break line portion of the subterranean wellbore's (10) walls (9) removed, with dashed lines showing hidden surfaces. The Figures show a method (1) embodiment (1H) and apparatus (2) embodiments (2H) that can be usable with a plurality of tool string (8) embodiments (8H) and downhole devices (3) to provide access or passage through the walls of dissimilar contiguous passageways (9H). The embodiments (1H, 2H) of the methods (1) and apparatus (2) can be usable with, e.g., tool strings deploying image logging downhole devices (3) that can be usable to empirically measure, e.g., three dimensional space disposition, orientation, inclination, temperature, pressure and orientation of various walls, as well as to look ahead, with continuation imaging, to determine a most likely axial orientation between wall portions (4H and 5H), necessary for the planning and selective configuration of a tool string embodiment for access and passage to the lower end of the well bore (10), below the substantially differing circumferential deformations and/or debris caused by strata movement (38).

Logging of the maximum force (38H1) plane and minimum force (38H2) plane of strata movement, as well as strata bonding to the collapsed conduit, and strata properties above and possibly below the moved strata, may be possible using an imaging logging downhole device (3), with the string (8) oriented by a plurality of shafts (6) of the circumferential adaptable apparatus (2H) and an axial pivotal member (7) engagement with various wall portions.

The plurality of tool strings (8), downhole devices (3H) and associated circumferential adaptable apparatuses (2H) can comprise various coiled strings comprising, e.g., slickline, electric line or coiled tubing or jointed shafts or pipes used within the walls of the dissimilar passageways (9) for their various properties. The various properties can include: i) the ability of coiled strings to be deployed and retrieved relatively quickly, when compared to jointed pipe, to allow more runs in and out of the well bore (10); ii) the ability to more easily rig-up pressure control equipment above an existing valve tree, or Xmas tree, and wellhead as well as seal around a continuous coiled string using, e.g., a stuffing box or grease injector head, compared to jointed pipe, snubbing and/or stripping operations; iii) the ability to quickly change logging tools and provide real-time image logging information using, e.g. electric line or memory data using, e.g. slickline compared to pulse communicating logging tools at the lower end of a jointed string; iv) the ability for logging information transmitted through the casing and using embodiments of the present invention; and v) the associated ability to make a plurality of tool string runs into and out of the well with various tools, as wells as the ability to make smaller and more controllable deformations of damaged downhole well components, to reduce the risk of side-tracking a well when providing access and passage, as compared to the jointed pipe operations. The advantage of using jointed pipe is, e.g., its ability to more effectively rotate and mill damaged well components into small pieces, once the well can be killed and/or the reservoir fluid connection with surface or sensitive strata formations becomes controllable.

Additionally, the plurality of tool strings (8H) and associated deployments may include, e.g., the above image logging downhole device (3H) electric line deployment, followed by a slickline deployment of an explosive sculpting downhole device (3H) similar to, e.g., (4I, 4J, 3Y and 3M1-3M3) wall portions and downhole devices of FIGS.

Figure 24:
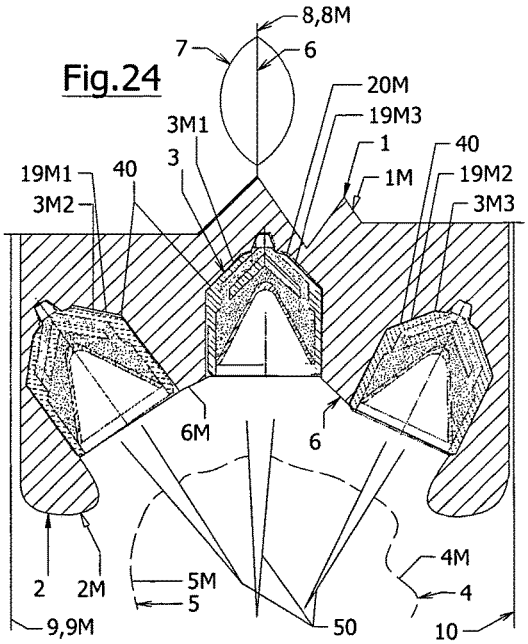
FIG. 24 shows an embodiment of a shaped charge sculpting circumferential engagement apparatus deployable on wireline, coiled string or jointed pipe to provide access or passage through a subterranean well bore's dissimilar contiguous passageway walls.
Figure 54:
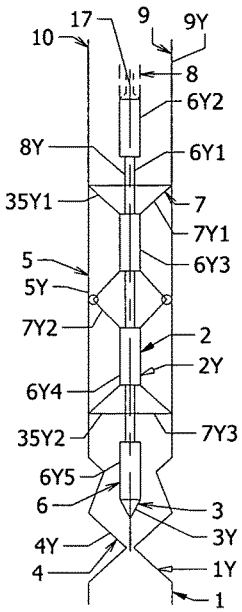

18-20 and FIGS. 24 and 54, respectively. The slickline deployment of the explosive sculpting downhole device (3H) may be followed by a slickline deployment of an abrasive milling downhole device (3H) similar to, e.g., the fluid turbine downhole device (3AE1-3AE2) of FIGS. 60 to 67, which may be followed by slickline deployment of wedging downhole devices (3H) similar to, e.g., wedging devices (3W, 3Z) of FIGS. 55 and 59, respectively, which may be followed by a small diameter relatively flexible jointed pipe deployment using conventional carbide encrusted milling downhole devices (3H) oriented with a circumferential adaptable apparatus (2H) that can be usable to pilot the conventional mill into position. The deployment of the small diameter relatively flexible jointed pipe may be followed by a relatively flexible jointed pipe deployment of an expandable conduit downhole device (3H) that can be piloted through the dissimilar passageway walls (9) with a circumferential adaptable apparatus (2H). Thereafter, the conduit can be expanded to provide access and passage through frictionally obstructive debris (18) within, or at least a partially restricted circular or deformed circumference of, said dissimilar passageway walls (9).

Figure 18:
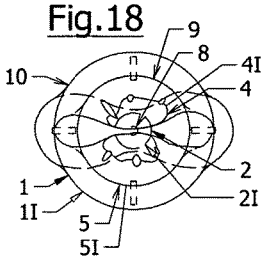
Figure 19:
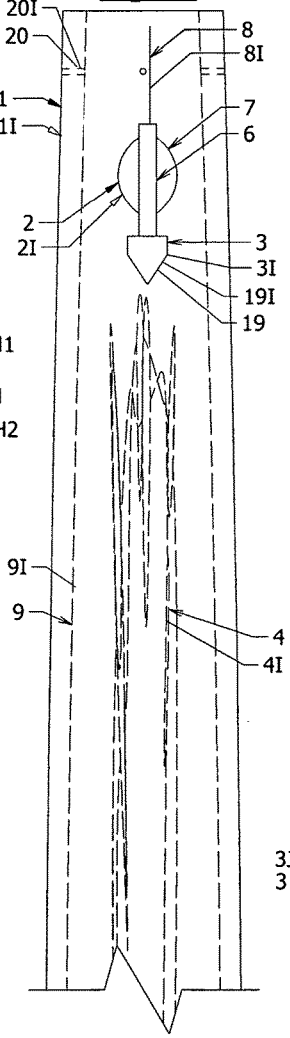

Referring now to FIGS. 18 and 19, the Figures depict a plan view and the upper end of an elevation view above a break line, with dashed lines showing hidden surfaces, which illustrate a method (1) embodiment (10 and apparatus (2) embodiment (2I), usable with a tool string (8) embodiment (8I) and downhole device (3) to provide access or passage through walls of the dissimilar contiguous passageways (9I). Previous deformation of a wall portion (4) has resulted in a new wall portion (4I) providing an axially deeper dissimilar passageway wall (9I) formed by and/or usable with a downhole device (3I), comprising, e.g., an explosive sculpting downhole device (19) embodiment (19I) using, e.g., oriented shape charge downhole devices (3, and 3M1-3M3 of FIG. 24) aligned transverse (20I) to the passageway and/or axially downward (20J) to form perforating downhole device (20) embodiments (20I, 20J) of FIGS. 19 and 20, respectively, oriented by a circumferential adaptable apparatus (2I), a plurality of shafts (6), and an axial pivotal member (7) to deform the wall portions (4I, 5I) and provide access or passage through the dissimilar passageway walls (9).

Figure 26:
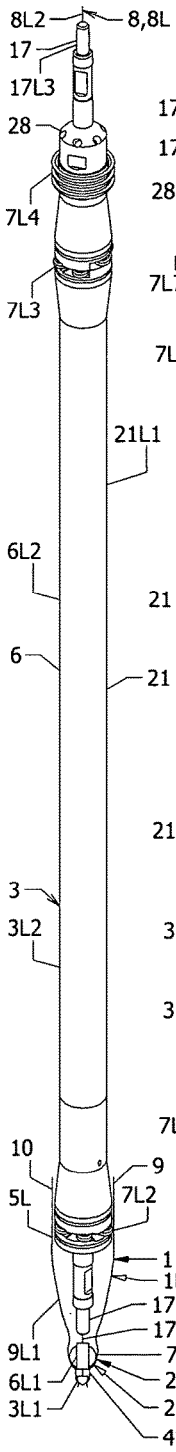
Figure 27:
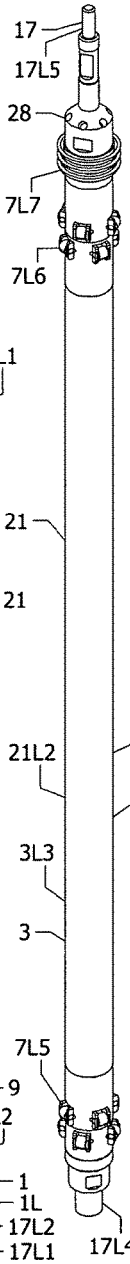

Alternatively, the downhole device (3H) may comprise a boring bit with an upper end motor (21), e.g., (21L1) and (21L2), with associated upper end coiled string compatible connectors (17L1) and (17I2) of FIGS. 26 and 27, respectively, which comprise said plurality of shafts (6). Perforations (20I) may be placed to allow fluid circulation if fluids cannot be injected into the reservoir through the walls of the dissimilar passageways (9) of the well bore.

Figure 20:
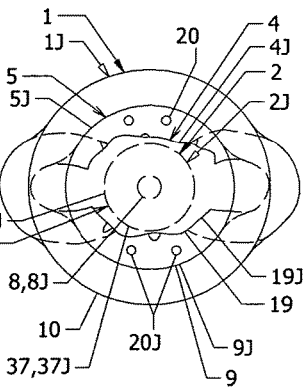

FIG. 20 shows a plan view, with dashed lines showing hidden surfaces, depicting a method (1) embodiment (1J) and apparatus (2) embodiment (2J) which can be usable with a tool string (8) and downhole device (3) to provide access or passage through walls of the dissimilar contiguous passageways (9J). Axially explosive cutting perforation (20) downhole devices (20J) or explosive sculpting (19) downhole devices (19J) can be used to weaken a wall portion (4J) and to disturb supporting strata behind said wall portion to aid a wedging (37J) or boring downhole device (3J) that is engaged to the circumferential apparatus (2J), which was deployed with a string (8) embodiment (8J) to further deform said wall portion (4J) toward the contiguous wall portion (5J) and provide access or passage through the walls of the dissimilar passageways (9).

Figure 21:
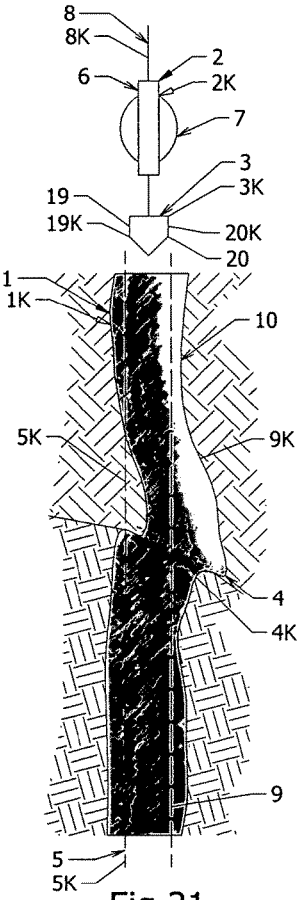

FIG. 21 illustrates a diagrammatic elevation view, with dashed lines showing the well bore prior to deformation, depicting a method (1) embodiment (1K) and apparatus (2) embodiment (2K), which can be usable with a tool string (8) embodiment (8K) and downhole device (3) to provide access or passage through dissimilar contiguous passageway walls (9K). This access or passage can be provided by, e.g., using a plurality of coiled string, tool string (8) deployments (8K), using a plurality of explosive sculpting and cutting (19) downhole devices (19K), and/or perforating (20) downhole devices (20K) and alternating the deployment of image logging downhole devices (3K), operating sensors, to measure deformation of the explosively deformed dissimilar passageway walls (9), including any wall portions (4K, 5K), as shown in FIG. 21. Any shaped charges (40 of FIGS. 22 and 23) can be arranged according to the previous image log data in, e.g., the oriented arrangement (2M) of FIG. 24, to provide passage between the upper and lower ends of the wellbore (10) in selectively controllable tool string runs and method steps, whereby after gaining access to the lower end of the well bore, it may be, e.g., abandoned or suspended to allow repair of the walls of the dissimilar passageways (9), without a fluid connection to the reservoir during said repair or abandonment.

Figure 22:
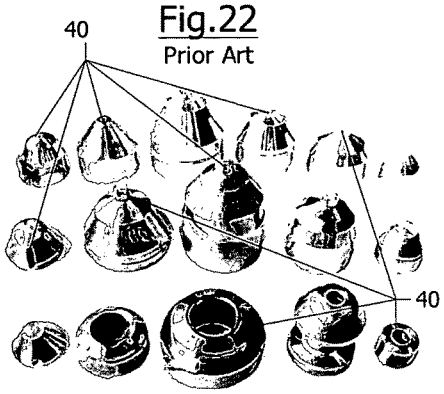
Fig.22 Prior Art
FIGS. 22 and 23 show prior art shaped perforating charge downhole devices.
Figure 23:
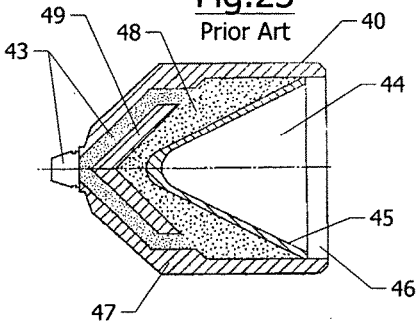
Fig.23 Prior Art

Referring now to FIGS. 22 and 23, the Figures illustrate an isometric view and cross section along the explosive cutting axis of prior art shaped charge (40) technology, wherein any shape and size of shaped charge is available to provide selective control of explosive perforating and sculpting operations. Generally, a shaped charge is comprised of a liner (45), explosive (48) and case (47). The case (47) defines an interior volume in which the liner (45) is positioned, wherein the liner (45) defines an interior volume (44) and has an opening thereto. The opening is surrounded by a rim portion (46) of the liner (45), whereby the ignition system (43) ignites the explosive (48), which explodes in a pattern associated with the deflector (49), interior volume (44) and casing (47) shape to exit through the rim portion (46) in an explosive cutting force jet (50 of FIG. 24), that can be selectively controlled by the various components of the shaped charge (40), and which is usable within embodiments of the present invention to perforate and/or sculpt wall portions (4, 5) in a controllable manner according to the orientation of any shaped charge or other explosive and/or associated chemicals forming a chemical cutter that can be piloted through a deformed passageway of substantially differing circumferences along a wellbore's walls (9).

FIG. 24 shows a diagrammatic cross section view through the explosive cutting axis, with dashed lines showing the wellbore walls being further deformed by the method (1) embodiment (1M) and apparatus (2) embodiment (2M), usable with a tool string (8) embodiment (8M) and downhole device (3) to provide access or passage through walls of the dissimilar contiguous passageways (9M). Using image logging tool string empirical data, the engagement and orientation of a circumferential adaptable apparatus (2M) with the dissimilar contiguous passageway (9M) wall portion may be arranged and carried out to provide a selective deployment and sculpting or perforating of a wall portion (4M) to form a larger wall portion (5M), proximally axially contiguous with the desired access and passage of tools using (19M1-19M3) shaped charges (40), or perforating (20M) shaped charges (40), comprising selectively oriented devices (3M1, 3M2, 3M3) within the apparatus (2M) piloted by its shaft (6) housing (6M) and axial pivotal member (7) at the lower end of the tool string (8). As explosives may form relatively sharp debris and/or sharp edges on deformed walls, various other embodiments are usable to pilot the traversable dissimilar passageway to deform explosive debris.

Additionally, the axial firing of explosives presents the problem of transmitting a fluid hammer effect axially within the wellbore, whereby the objective is generally to focus or funnel such a fluid hammer away from the surface and toward the walls being deformed. Various apparatus embodiments, e.g., 2X, 2Y, 2W and 2Z of FIGS. 45, 54, 55 and 59, are usable to absorb and/or focus/direct a fluid hammer effect associated with and similar to axially oriented explosive jets (50).

Figure 25:
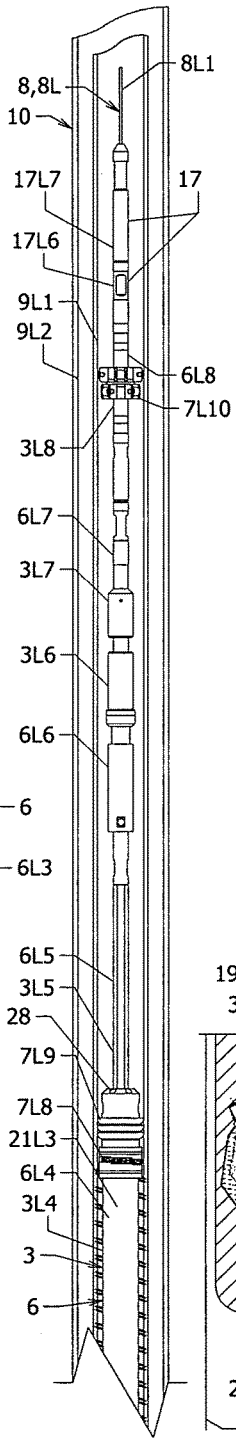

Referring now to FIGS. 25, 26 and 27, the Figures depict rotary cable tools of the present inventor, wherein FIG. 25 shows an elevation view of a slice through the walls (9L1, 9L2) of the well bore (10), usable with FIG. 26, which depicts an isometric view of an embodiment using a rotary cable tool motor and a reactive torque tractor. FIG. 27 shows an isometric view of a cable conveyable positive displacement fluid motor rotary cable tool, also usable, with the FIG. 26 method (1) embodiment (1L) and apparatus (2) embodiment (2L), comprising a tool string (8) embodiment (8L) for using a downhole device (3) to access or pass through the walls of the dissimilar contiguous passageways (9L1), wherein the various functions of (6L2-6L8, 7L2-7L10, 17L2-17L7 and 21L1-21L3) are further described by the present inventor in application publication GB2484166A.

Various elements of a tool string (8L1) may represent both members of a circumferential adaptable apparatus (2L) and a downhole device, e.g., a plurality of shafts segments (6L2, 6L3, 6L4) may comprise motor downhole devices (3L2, 3L3, 3L4, respectively). The shafts or motors, may be those of the present inventor or, e.g., conventional electric or hydraulic downhole motor devices. Similarly, axial pivotal members (7L2-7L10) may represent various coiled string compatible and pilotable members that extend from the axis of the tool string via a flexible hinge, e.g., the drive wheels of a reactive torque motor tractor (7L2-7L3, 7L9) can flexibly extend and retract from a shaft (6L2, 6L4, respectively) via the torque caused by rotation. Sealing cup seals (7L4, 7L7, 7L9) can flexibly expand and contract from between a shaft (6L2, 6L3, 6L4, respectively) and wellbore wall to direct fluid through orifices (28), past the kelly (3L5), swivel (3L6), emergency disconnect (3L7) and anti-rotation (3L8) string (8L1) members to a positive displacement fluid motor (21L1-21L3) device (3L2, 3L3, 3L4, respectively), and the anti-rotation devices (7L5-7L6, 7L10), for motor devices (3L3, 3L4, respectively), can be flexibly hinged to shafts (6L3-6L4, 6L8, respectively).

Alternatively the motor downhole devices, for example (3L2, 3L3, 3L4), can comprise electric motors or pneumatic motors, which can be piloted through and/or used to deform restricted passageways via the method (1L) and/or apparatus (2L) of the present invention. A downhole motor (21) device (3L2-3L4) or plurality of shaft segments (6L2-6L4) of a circumferential adaptable apparatus (2L) can be used to, e.g., rotate a shaft (6L1) and lower end boring bit downhole device (3L1), which can be piloted by an axial pivotal member (7L1).

Accordingly, while the present apparatus (2L) is preferred, the present method (1L) may use various conventional, prior art apparatuses and/or apparatuses of the present inventor assembled in an interoperable combination to form a tool string (8L2) to, in use, traverse a pilotable passageway between, or to deform a well bore's (10) lower end walls of a dissimilar contiguous passageway (9) formed by a first wall portion (4L) and at least a second wall portion (5L) of substantially differing effective circumferences.

FIGS. 28 and 29 depict isometric views of an embodiment (22O) of a pedal (22) usable for a pedal basket and an embodiment (14S) of a mechanical linkage arm (14) that can be usable together with various other embodiments (e.g. 7O) of an axial pivotal member (7) of the present invention. The flexible hinge (25O, 25S) can be formed with, e.g., a deformable material (30O1), engagable to a shaft of a circumferential adaptable apparatus (2). The pedal (7O) can be deployed between, e.g., wedging shafts, wherein an engagement wedge shaft (37O1) can be forced against a wedging shaft (37O2) to deform the material (30O1) of the flexible hinge (25O). A sealing deformable material (30O2), e.g. elastomeric material or coatings, can be used and placed at the wall engagement to provide a seal to the well bore wall (9).

The pedal (7O) can be deployed in any arrangement, e.g. like that of FIGS. 30 to 32, to provide engagement with a wellbore wall (9), wherein an orifice (28) for a mechanical arm (14S) engagement may be used to extend and/or retract the pedal (7O). The mechanical arm (14S) can be engaged to multiple axial pivotal members (7O) and/or member components, e.g. (7T) of FIG. 35, wherein the arm (14S) is connected between upper (22T1 of FIG. 35) and lower (22T2 of FIG. 35) pedals (7O).

Referring now to FIG. 30, the Figure shows a collapsed plan view of an embodiment (22P) usable with the FIGS. 31 and 32, which depict an expanded plan view and elevation view embodiment (22N) of a pedal basket (22), respectively, that can be usable with various other embodiments of axial pivotal member (7) embodiments of the present invention. Axial pivotal member pedals (7P), e.g. (7O of FIG. 28), which can be overlapped and deformed around a shaft to form a collapsed pedal basket (22P), may be expanded by any means, e.g. by wedging shafts (37O1-37O2 of FIG. 28) or mechanical arms (14S of FIG. 29) and/or a linkage with an inflatable membrane to form an expanded pedal (7N) basket (22N). The pedal basket (22N) may focus, support and/or protect, e.g., an elastomeric funnel, bladder and/or fluid inflatable packer/bag or cement like material or, e.g., the forces of a fluid hammer axially transmitted through a well bore by, e.g., an explosive or hydraulic jar.

An axial pivotal member of a circumferential adaptable apparatus (e.g. 7P/7N) can be interoperable with, e.g., shafts (6), passageways in shafts (24), springs, shock absorbers and any other downhole device, wherein it can be usable to automatically expand and collapse said axial pivot member so as to retain engagement with, or pilot, varying substantially differing circumferences as it is traversed through a well bore to, in use, pilot other engaged downhole devices (3), as shown, e.g., in FIGS. 35 to 44, embodiment (2T). Any material, e.g. carbide to abrade debris during passage or rotation and/or elastomers to seal against a wall portion during passage, can be engaged to a pedal (e.g. 22O of FIG. 28) to provide various downhole functions, wherein recovery of debris is not necessarily the objective, but possibly tool string deployment or displacement and associated intervention with wall portions necessary for piloting or further deforming of a passageway with the deployed tool string or another subsequent tool string.

FIGS. 33 and 34 depict collapsed plan view slices across a plane transverse to the shaft's axis, usable during, e.g., deployment and prior to expansion downhole or during retrieval of the axial pivotal member (7) embodiments (7R, 7Q, respectively) and membrane (15) embodiments (15R, 15Q, respectively), which can be usable with various other embodiments of the present invention. Various combinations of axial pivotal members, e.g., a pedal basket (22N of FIGS. 31 and 32) with the membranes (15R, 15Q), can be usable to form an axial pivotal member, e.g. similar to (7T) of FIGS. 35 to 43. Mechanical arms (14Q) can be incorporated with hinges (25Q), engaged to a membrane (15Q) for support around the membrane's circumference, to aid engagement with an irregular circumference of a wall portion (4, 5) and to aid urging the expansion or collapse of a membrane.

The folding of the membrane (15Q, 15R), which can be made of elastic material that can expand, provides increased enlargement capabilities compared to conventionally wrapping a single elastically expandable layer about a shaft. Shafts (6Q, 6R) may be solid or, as shown, may have an internal passage usable for an internal pass through shaft and/or fluid communication to operate a membrane (15Q, 15R), valve, motor, or other fluid device. An axial pivotal member can have a deployment diameter (58, as shown in FIGS. 30, 33, and 34) and associated circumference, which may be irregular as shown, and an effective diameter or circumference after expansions that may or may not (15A of FIG. 4) be proximally circular.

A membrane (15Q, 15R) can be arranged to form a bag or packer-like shape similar to (15A), (15T), (15U) of FIGS. 4-5, 35-43 and 58, respectively, or a conical shaped single continuous pedal basket (22Q, 22R); or a conical wrap similar to (22N) of FIGS. 31 and 32. The folding or overlapping of material or pedals can lessen with the axial distance from the plan view slices, as shown in FIGS. 30, 33 and 34 until a single layer, without folding or overlap, exists in a conical shape. For bag or packer shaped membranes, the progression from folding to single layer about the associated shaft occurs on both ends of the FIGS. 33 and 34 plan slice views. For conical shapes, similar to (22N) of FIGS. 31 and 32, the transition from folding or overlapping occurs on only one axial side of said plan view slices.

Accordingly, any form of cellular, envelope, bag or packer shapes may be formed to hold fluids within, and to separate cells forming a packer or single cell forming, a packer. Conical shapes may be formed to hold fluids or debris in one axial direction with significantly less fluid or debris holding capacity in the other.

Various membrane embodiments of the present invention need not be made of conventional inflatable elastomeric material, designed to hold a stationary position across a large differential pressure, but rather, in various instances, embodiments may be formed with relatively thin material capable of being folded. The present invention is capable of a larger expansion diameter to deployment diameter (58) ratio, compared to conventional apparatuses. For example (e.g.), a conventional 54 mm (2.125 inch) deployment diameter inflatable is capable of expanding to a 165.1 mm (6.5 inch) diameter as shown in FIG. 3, which results in a ratio of approximately 54/165.1 (6.5/2.125)=+/−3.1. The folded membranes (15R, 15Q), having a similar 54 mm (2.125 inch) deployment diameter, may be unfolded to a circumference equal to a diameter of 215.9 mm (8.5 inches); hence, the ratio before any expansion occurs is 215.9/54 (8.5/2.125)=4. With similar materials to those used in conventional inflatables, the expansion diameter to deployment diameter ratio will always be greater for the present invention, because the purpose of the present invention is different to that of a conventional inflatable, which is placed in an unsupported stationary position using slips against the wellbore to hold large differential pressures across the membrane. The present invention can traverse along the erratic axis of a wellbore, where a desirable function is to deform according to the circumferential shape of the wellbore. Conventional inflatables seek to cause friction with the wellbore, whereas the present invention can seek to place a lower differential pressure membrane across the wellbore and reduce frictional constraints to allow it to move through substantially differing circumferences using, e.g., fluid drive, engaged selective pressure valves and/or wheels to facilitate piloting of the tool string.

While radial folding is shown and explained relative to an expanded to deployment diameter ratio, folding may not be used in various embodiments while other embodiments may fold axially. A long axial length membrane, folded in two to, e.g. minimize the effective deployment diameter, may extend radially outward significantly beyond the deployment diameter, depending upon the axial length of a fold. Hence, the expansion to deployment ratio capabilities, using folding, are capable of expanding from the conventional coiled string smallest deployment diameter to the inside diameter of the largest casing, simply by making the axial length of the membrane longer.

Indeed, the present invention differs significantly from much of the prior art, where maintaining station with a pressure differential is the primary desired feature. The present invention can be usable for access and passage through a wellbore, whereby differentiating interoperability with a wellbore, in comparison to existing methods, may be illustrated by, e.g., an ability to increase the efficiency of crushing pistons, traversing a tortuous wellbore, to deform tubing using differential pressure and the elements of a geologic time frame to abandon a wellbore. The present invention is able to focus more on crushing, with less focus on the frictional forces for a crushing piston passing through a wellbore. One of the various objectives of the present invention is to reduce friction and to improve movement and, e.g., improve crushing above what might otherwise be expected through a tortuous passageway by adding the interoperability of, e.g. skates or fluid lubrication from permeable membranes (27T of FIGS. 35 to 41), after which the expanded membrane (15Q, 15R) may be used to support cement, and wherein the expanded membrane is supported by the debris that it has crushed. In instances where support is desired, e.g. when placing a settable cement-like material to seal a well bore, the present invention may, e.g., be rested upon debris within the wellbore. Additionally, interoperability may be added with inclusion of positive displacement valves (11A of FIG. 4), used within a shaft and a membrane to fill said membrane, and to further provide fluid lubrication (27T of FIGS. 35 to 41) while maintaining its expansion and/or bleeding-off trapped pressure for passing through restrictions or trapped pressure that is resisting the crushing of well components, whereby bleeding off to reduce friction operates a momentum vibrator (12A of FIG. 4). As objects in motion tend to stay in motion, momentum vibrators may significantly increase the crushing ability of an embodiment.

Operability between, e.g., wheeled mechanical linkages or skates (7T1 and 7T3 or 26T1 and 26T2 of FIG. 35), membranes (15R, 15Q), pedal baskets (22P, 22N of FIGS. 30 to 32), and an associated plurality of shafts and/or other axial pivotal members, which are usable to pilot, orient, place, retrieve, dispose, initiate, connect and/or provide other functions associated with access or passage through a well bore using any type of connector, preferably a coiled string compatible connector, may simply be referred to as interoperability between a circumferential adaptable apparatus (2), associated downhole devices (3), and the associated tool string (8) when traversing substantially differing well bore circumferences.

FIG. 35 shows an elevation view while FIGS. 36 to 44 show various other views of a method (1) embodiment (1T) and an apparatus (2) embodiment (2T) usable with a tool string (8) embodiment (8T) and downhole device (3).

The tool string may be deployed before or after actuation of springs (23T1-23T4) used to store energy within the tool string, which may occur at surface or within a well bore. Any downhole conventional actuator device (42), e.g. an electric mechanism, timer mechanism, slickline pump, hydrostatic pressure actuator or small explosive charge actuator between the coiled string compatible connector (17) and circumferential adaptable apparatus (2T), at the lower end of the string (8), is usable to actuate the tool string (8T) by axially compressing shafts (6T1-6T9) disposed about and along a central shaft (6T10), against said springs (23, 23T1-23T4), to selectively trap energy within the apparatus (2T) for axial pivotal member (7, 7T1-7T3) expansion. As shown in FIG. 35, the upper axial pivotal member (7T1) includes hinged arms (14T1, 14T2) and hinged (25T1, 25T2, 25T3, 25T4) embodiments for enabling its expansion, while the lower axial pivotal member (7,7T3), e.g., lower skate, includes hinged arms (14T4, 14T5) and a number of hinged (25T9, 25T10, 25T11, and 25T12) engagements for enabling the expansion of the lower axial pivotal member (7,7T3). Any form of slips or other positional device may be used to retain the selective axial combined length of the shafts (6T1-6T9) and springs (23T1-23T4) to store energy along the central shaft (6T10), associated with the level of stored energy usable for initiating expansion and resisting collapse of the axial pivotal members (7, 7T1-7T3).

Interoperability can occur between a plurality of shafts (6, 6T1-6T10), with intermediate springs (23T1-23T4) operable between upper (26T1) and lower (26T3) skates, and use of an intermediate axial pivotal packer (7T2) to pilot between the substantially differing circumferences of the, e.g., 73 mm (2⅞ inch) outside diameter 12.8 kg/m (8.6 pounds per foot) production tubing, with an inside drift diameter of 55 mm (2.165 inches), within a casing bore (5T) of, e.g., 216.8 mm (8.535 inches) inside diameter of an outside diameter of 244.5 mm (9⅝ inch) casing, associated with 79.8 kg/m (53.5 pound per foot) density; wherein the inside diameter and associated circumference of the casing (9T2) is deformed (4T). An embodiment (2T) of the apparatus (2) has, e.g., a 53.3 mm (2.1 inch) collapsed deployment diameter to traverse the expandable packer (7T2) between the 55 mm (2.165 inch) and 216.8 mm (8.535 inch) diameters, as well as the casing deformities, by using the skates (7T1, 7T3 or 26T1, 26T2) to pilot the packer (7T2), with string tension and/or pressure applied (31) to the packer from the tubing against any pressure underneath the packer. The apparatus (2T) deployed with, e.g., the coiled string connector at its upper end and/or pressure applied through the tubing to the upper end of the packer (7T2), carries a downhole device (3T) at its lower end for access and passage through the substantially differing circumferences (1T).

The lower end downhole device (3T) may be any usable downhole device that is deployable with a shaft (6T9) connector and/or upper end coiled string connector, for example (e.g.) a perforating or explosive sculpting charge, a logging tool, an actuating tool or a motor, a boring bit or an abrasive device, or a wedge. Various arrangements may be used, e.g., the central shaft (6T10) may rotate with bearings within encompassing housing shafts (6T1-6T9) to turn a boring bit (e.g. 3T) that can be operated with, e.g., a 42.7 mm (1.68 inch) outside diameter fluid motor, above the apparatus (2T) and held substantially stationary by the skates (26T1, 26T2), and also used to orient a hole finding device (e.g. 3T) and lower end boring bit. If a rotary cable tool positive displacement hydraulic motor of the present inventor is used, the packer (7T2) may be used to route circulated fluids upward through the annulus after exiting the lower end of the 73 mm (2⅞ inch) tubing.

Figures 36, 37, 38, 39, 40, 41, 42, 43, 44:
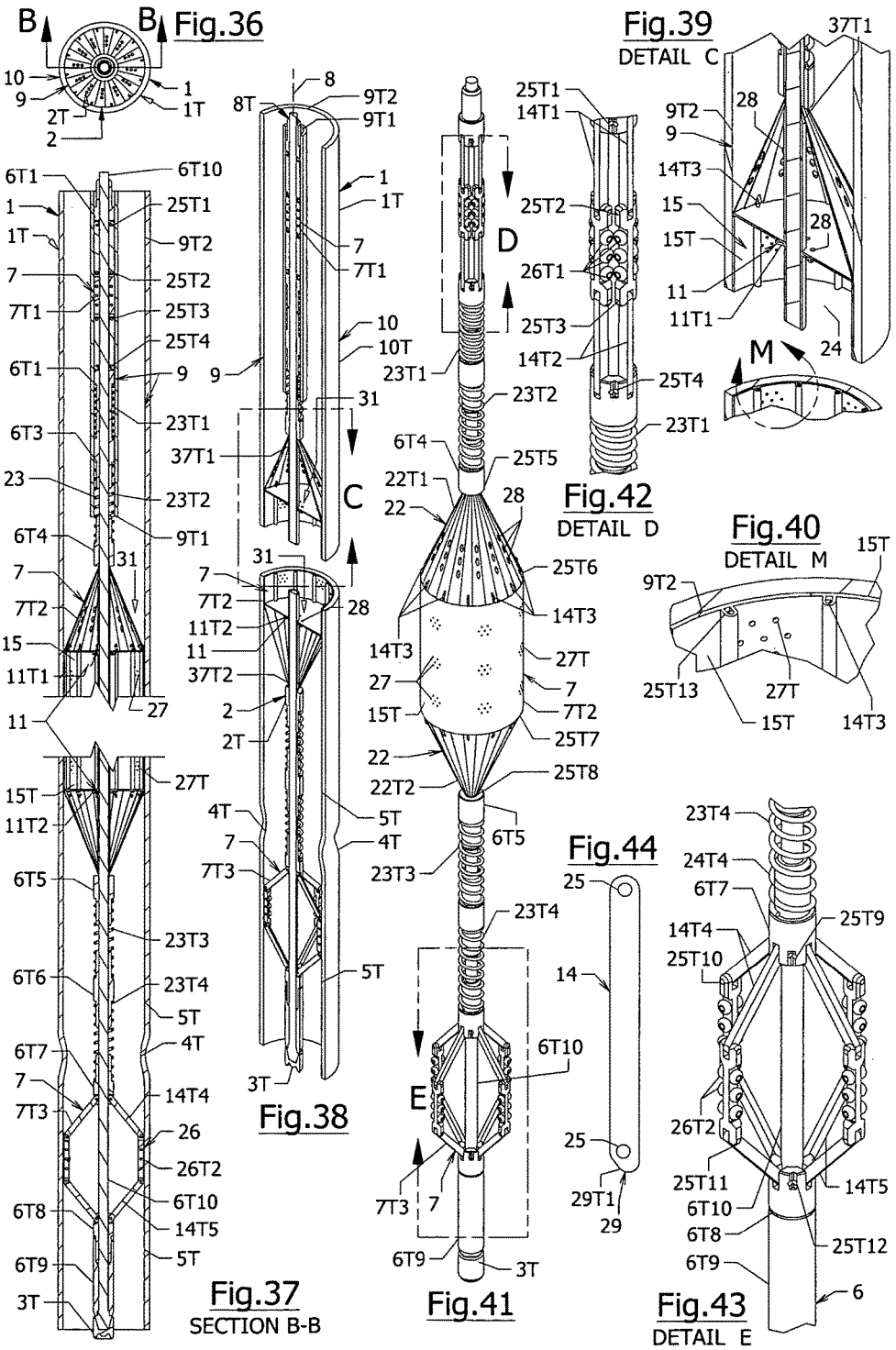

Interoperability may be enhanced with orifices (28, as shown in FIGS. 38 and 41), permeable membranes (27, 27T) portions and/or valves (11, 11T1, 11T2, as shown in FIG. 37), which can be operable with the primary membrane (15, 15T) to allow fluid to be pumped into, and exhausted from, the well, or to allow the membrane to lubricate the traversing engagement between the axial pivotal member (7T2) and the dissimilar passageway walls (9T1, 9T2, 4T, 5T, as shown in FIGS. 37 and 38). The upper (22T1) and lower (22T2) end pedal baskets (22) may be used to flexibly protect the membrane when traversing through the wellbore (10). The primary membrane (15T) and associated pedal baskets (22T1, 22T2) may be further reinforced by hinged arms (14T3) about their engagement circumference, wherein fluid pressure against the membrane, axial movement of the internal shaft (6T10), and/or wedging of the upper inverted pedal basket (22T1) against, e.g., the 5.3 cm (2⅞") tubing or wall portion (4T), may be used to wedge and/or inflate or deflate the membrane (15T). The upper (22T1) end pedal basket is shown flexibly hinged (25T5, 25T6) to the shaft and primary membrane, respectively, and the lower (22T2) end pedal basket is shown flexibly hinged (25T7, 25T8) to the primary membrane and shaft, respectively.

The apparatus (2T) and lower end downhole device (3T) may be deployed and retrieved with a coiled or jointed pipe string, but the apparatus (2) and lower end downhole device (3) may also be dropped from a string or surface to, e.g., use fluid pressure above the packer (7T2), with a wedging device (3T) comprising, e.g. another pedal basket or other expandable device, which can be suitable for urging or wedging at the lower end, to, in use, attempt to push and deform walls and/or debris radially outward and/or axially downward, independently of a string connection. Thereafter, the tools (2T, 3T) could be retrieved with a coiled string via a fishing neck. The present invention provides significant benefits by centralizing the tool string to improve the probability of fishing the dropped tool string.

Referring now to FIGS. 36, 37 and 38, the Figures show a plan view with line B-B, and an elevation cross section view along line B-B with break lines showing removed portions associated with the FIG. 38, which depicts an isometric view of FIG. 37 with portions removed, where detail line C is associated with FIG. 39. FIGS. 36, 37 and 38 illustrate a method (1) embodiment (1T) and an apparatus (2) embodiment (2T) usable with a tool string (8) and downhole device (3) for accessing or passing through the walls of the dissimilar contiguous passageways (9T1, 9T2, 4T, 5T) of a wellbore (10) embodiment (10T). The circumferential adaptable apparatus (2T) is shown with its lower end having passed a damaged wall (4T) and large diameter change of, e.g. a 73 mm (2⅞ inch) tail pipe (9T1) axially centralized within a casing (9T2) by, e.g., a production packer.

Alternatively, the tubing could be laying on the low side of an inclined or horizontal bore, e.g. see FIG. 4, whereby the spring (23T4) activated lower skate (7T3) may lift and pilot the tool string over the deformation (4T) until the springs cause the packer (7T2) to pilot and orient the tool string. The packer can pilot the tool string towards the proximal axis of the wellbore until the tool string exits the tubing, including both skates (7T1, 7T3) and the packer (7T2), assisted by springs, string tension and fluid that is axially pumped within the well bore to pilot the entire assembly within the proximal centre of the wellbore, as the coiled string interacts with the tubing to lift the coiled string and/or form a catenary curve with the trailing string, as the tool string traverses through the wellbore, past the deformation (4T), to the wells lower end.

FIGS. 39 and 40 show magnified detail views, within the detail line C of FIG. 38 and the detail line M of FIG. 39, respectively, of the embodiments (1T, 2T) of FIG. 36. The upper end pedal basket (22T1, shown in FIG. 41) has orifices (28) to allow fluid pressure from the surface to enter the membrane (15, 15T) through the upper one-way valve (11, 11T1) usable with, e.g., shaft mounted springs to fluidly inflate the membrane (15T) and to pump fluids through permeable pores (27T shown in FIG. 41) in the membrane (15T) for lubricating its circumferential connection with the wellbore, when pumping and traversing through various circumferences within, thus allowing it to inflate and deflate according to the restriction, yet retain the function of a sealed compression piston or movable packer.

Deforming around restrictions and debris when piloting and traversing through the wellbore is aided by mechanical linkages (14T3) and hinged (25T13) engagements to individual pedals of the basket (22T1 shown in FIG. 41). For various embodiments, a momentum vibrator (12A of FIG. 3) or positive displacement valve (11A of FIG. 3) can be added to the arrangement to further enhance interoperability between the tools and the dissimilar passageway walls, by controlling fluid pressure with the membrane (15T) and/or by increasing lubrication about its circumference. In various other embodiments, e.g. one similar to (1X) and (2X) of FIG. 45, small diameter fluid motors, which are conventionally available in, e.g., a 1.68 inch outside diameter plurality of shaft arrangements, that may be incorporated with or at an end of the membrane (15T) to power, e.g., a reactive torque tractor for moving the tool string along the walls of the dissimilar passageways using, e.g. the gripping and/or cutting wheel of the skate (26T1, 26T2) arrangements shown in FIGS. 41 to 43.

Referring now to FIGS. 41, 42 and 43, the Figures show an isometric view of FIG. 35 with detail lines D and E and magnified detail views within lines D and E of FIG. 41, respectively, illustrating the embodiments (1T, 2T) of FIG. 35. The axial length of mechanical linkages (14T1 and 14T2, 14T4 and 14T5) may be varied between the shaft connection and the hinged (25T2 and 25T3, 25T10 and 25T11, respectively) connection to the skates (26T1, 26T2, respectively) to accommodate varying diameter ranges, and where sufficient space exists within a circumferential adaptable apparatus (2), independent springs can be engaged to each skate to selectively pilot the tool string. A series of springs, surrounding the central shaft, can be individually engaged to each skate or smaller diameter springs, placeable within the radial distances between, e.g., a central shaft and encompassing or surrounding shaft.

A deformable packer and wedging axial pivotal member (7T2) is formable with an upper pedal basket (22T1) flexibly hinged (25T5, 25T6) to a shaft (6T4) and mechanical linkage (14T3), supporting and flexibly hinged (25T13) to the upper end of a deformable membrane (15T), which can be engagable with the wall portions (9T1, 9T2). Permeable pores (27T) can allow fluid lubrication of the engagement when traversing the dissimilar contiguous passageway (9T, 9T1, 9T2). The membrane's (15T) lower end can be flexibly hinged (25T7) with a mechanical linkage (14T3) to the lower end pedal basket (22T2), flexibly hinged (25T8) to the shaft (6T5).

Upper and lower springs (23T2, 23T3) can act against associated upper and lower wedge (37T1, 37T2, as shown in FIG. 38) shafts encompassing the central shaft (6T10), to urge the expansion of the upper and lower pedal baskets (22T1, 22T2) to initiate a fluid filling of the membrane (15T) through the one way valve (11T1) and orifices (28) in the upper inverted basket (22T1). Pores (27T) in the membrane may be of a one-way flow variety using, e.g., the flap and orifice (28) example valve (11), as shown, or open to allow initial filling of the membrane (15T). After initial spring actuated expansion and fluid filling of the membrane (15T), further fluid filling can be possible by surface fluid injection (31) through the orifices (28) in the upper basket (22T1) and upper one-way valve (11T1), wherein fluid exiting the lower one way valve (11T2) can act against the lower basket (22T2) to further expand the membrane (15T), by acting against and expanding the lower basket (22T2). An internal passageway (24T4) may be added to the shaft to facilitate filling from any lower point along the shaft, wherein a swivel joint (6T8) may be used to allow rotation of the central shaft for any displacement valve and/or momentum vibrator using the internal passageway (24T4) and membrane (15T).

Collapse of the axial pivot member (7T2) can be accomplished by, e.g., stopping injection of fluid (31) and tensioning the string to pull the upper basket (22T1) into the lower end of the tubing (9T1), so as to compress the springs and force fluid from the membrane (15T). Fluid may be expelled from the membrane through the pores (27T) and between pedals as the lower basket (22T2) is collapsed. If fluid filling from the lower end is not a concern, orifices can be used instead of a one-way valve (11T2).

Figure 46:
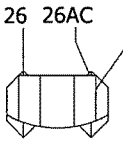
FIGS. 46 to 51 illustrate various wheeled skate embodiments of the present invention.
Figure 48:
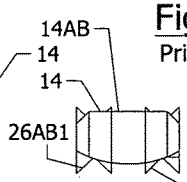
Figure 47:
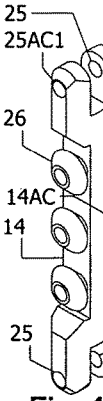
Figure 49:
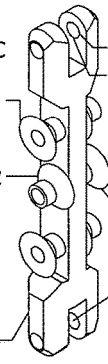

Any variation of wheel(s) can be engaged to a skate (26) or an axial pivotal member (7) to, e.g., reduce friction, pilot the tool, prevent rotation of a shaft, and/or cut the walls (9) of a wellbore, for example, (26AA, 26AB, 26AC) of FIGS. 46 to 48. As the type and diameter of the wheels will affect the circumferential adaptable apparatus (2T) deployment diameter, as shown in FIG. 42, the purpose and associated shape should be considered, wherein selective adjustment of a mechanical arm (14) length and an actuator, e.g. spring force, may be matched to the wheel and purpose.

FIG. 44 shows an elevation view of an embodiment (29T1) of a shaped (29) mechanical linkage arm (14) that can be usable with various embodiments, including that of FIGS. 35 to 43, wherein a lower-end cam-like shape (29T1) can be used to support the arm against a central shaft (e.g. 6T10 of FIGS. 35 to 43). Interoperability between tools of the tool string (8T) may be enhanced by selectively placing shaped (29) linkages, like the cam embodiment (29T1), wherein by placing a cam shape, e.g., at the upper hinges (25T1, 25T4) or lower hinges (25T9, 25T12, as shown in FIG. 43), tends to aid retraction of the arms (14) with string/shaft tension and to aid extension with shaft compression. Placing the cam shape on the lower hinges (25T2, 25T5) tends to aid extension of the arms (14) with string/shaft tension and to aid retraction with shaft compression. The shape may also be used to limit expansion and retraction of the arms (14).

As illustrated in the example tool string (8T), various embodiments of the methods (1) and apparatus (2), interoperable with a downhole device (3) to form a string (8) of the present invention, can be combinable in a variety of ways to meet the needs of access and passage through damaged and/or restricted portions of a well bore, wherein various forms of pedal baskets, membranes, skates, valves, hinges (25), springs or any other downhole coiled string compatible mechanisms, oriented and arranged at surface and downhole, can be usable to selectively pilot any suitable downhole device (3T), selectively actuated by any suitable actuation means.

FIGS. 45, 54 to 56 and 58 to 59 are diagrammatic illustrations of various methods of the present invention, wherein the associated apparatuses of each Figure may include any apparatus embodiment of the present invention, in addition to the depicted apparatuses.

Figure 45:
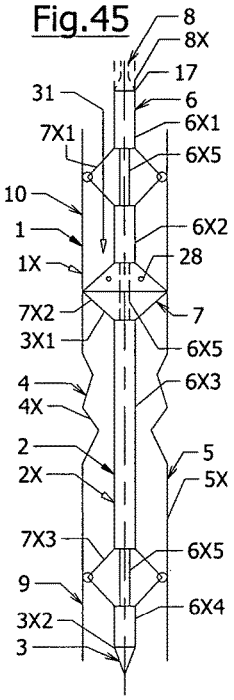
FIG. 45 shows a reduced friction embodiment of the present invention usable for access or passage through subterranean well bore dissimilar contiguous passageway walls.

Referring now to FIG. 45, the Figure depicts a diagrammatic elevation view of a slice through a well bore (10), illustrating a method (1) embodiment (1X) and apparatus (2) embodiment (2X), usable with a tool string (8) embodiment (8X) and downhole device (3) for access or passage through the walls of dissimilar contiguous passageways (9) of a well bore, wherein the walls comprise wall portions (4X, 5X). The tool string (8X) is usable to, e.g. mill the dissimilar wall portion (4X), by placing any variation of cutting wheel arrangement, e.g. (26AC) and (26AB1, 26AB2) of FIGS. 46-47 and FIGS. 48-49, respectively, and using a hydrodynamic fluid bearing milling motor, as described in GB2486591 of the present inventor, to rotate the axial pivotal member (7X2) comprising, e.g., carbide encrusted basket pedals (3X1) with overlapping pedals arranged for the direction of rotation and operated by power fluid passing through the top inverted pedal basket orifices (28), for turning a rotating stator motor shaft (6X3), which can be secured to the cutting carbide encrusted baskets (7X2) and rotated about a central shaft (6X5), which is held substantially stationary by the axial pivotal cutting skate members (7X1, 7X3).

As fluid is pumped (31) through the orifices (28) and between the rotatable stator shaft's (6X3) hydrodynamic surface and the central substantially stationary shaft (6X5), the power fluid (31) rotates the carbide baskets (7X2) to mill the dissimilar wall portion (4X), which may be axially cut by the skates (7X1, 7X3) when the tool string (8X) is raised and lowered with string (8) tension. The shape of the opposing baskets, their flexible pedal nature, and the string tension when moving the rotating baskets across the dissimilar wall portion (4X) gradually grinds and/or smooth's the disfigured or restricted well bore (10) to allow passage of other tools and strings. The lower end downhole device (3X) may, e.g., be a calliper tool used to measure the well bore's (10) walls (9).

The tool string (8X) can be usable with a conventional electric or fluid motor, forming the shaft (6X3) instead of a hydrodynamic fluid bearing motor with a lower end rotary downhole device (3X), wherein the upper and lower skate axial pivotal members (7X1, 7X3) can hold the upper wireline connector (6X1), central (6X2) and the conventional motor's housing (6X3) shaft segments substantially stationary while the central shaft (6X5) and lower shaft (6X4) segments rotate the bit, brush, grinder or jetting tool (3X2), using fluid funnelled through the orifice (28) from the axial pivotal member (7X2), or any other suitable rotary tool.

FIGS. 46 and 47, FIGS. 48 and 49, and FIGS. 50 and 51, illustrate mechanical linkage (14) embodiments (14AC, 14AB, 14AA, respectively) with wheeled (26) embodiments (26AC, 26AB1 and 26AB2, 26AA, respectively) and hinged (25) embodiments (25AC1 and 25AC2, 25AB1 and 25AB2, 25AA1 and 25AA2, respectively), usable with various other embodiments of the present invention. Wheeled skates (26) can be engaged to shaft segments (6X1-6X4 of FIG. 45) that can encompass or surround the central shaft (6X5), which may be substantially stationary or rotatable during deployment, wherein tensioning and relaxing of tension within the shaft (6X5 of FIG. 45) extends and retracts the axial pivotal members (7X1-7X3 of FIG. 45) by disposing the shafts (6X1-6X4 of FIG. 45) along the central shaft to urge expansion and retraction of the members. Various actuators may be used to both extend and retract the members by tensioning and removing tension from the central shaft (6X5 of FIG. 45). Skate (26) wheel configuration profiles, including the number and orientation of wheels and skates, can be usable to cut and/or function as an anti-rotation device to prevent axial rotation of a connected shaft. Depending upon the application, a variety of axial cutting wheel configurations may be used to deform a well bore wall through a relatively low frictional cutting action, wherein repeated axial movement of the tool string (8) within the well bore tends to progressively weaken and/or shred the affected wall portion.

The shape of the wheeled components and associated linkage arms for extension and retraction are generally configurable to fit within the minimum diameters of a wellbore, wherein a single skate may be used with the deployment to urge shaft engagement with the wellbore, or two skates may be used to cause helical turning about, e.g. a ball joint shaft or other anti-rotation mechanism, or three or more skates may be used to provide, e.g., anti-rotation, centralization and/or orientation of an embodiment to pilot at least the lower end of a tool string, for access or passage through an obstructive dissimilar contiguous passageway of a wellbore.

Any embodiment of the present invention may use bearings, races, greases or other friction reducing devices to, e.g., improve hinged connections (25), rotating connections, radially disposed connections, axially disposed connections, and/or any other configuration of wheeled (26) mechanical linkages to provide, e.g., anti-rotation, centralization and/or engagement of a tool string to a wellbore.

Figure 52:
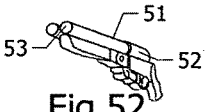
Fig.52 Prior Art
FIG. 52 shows a prior art shot gun.
Figure 53:
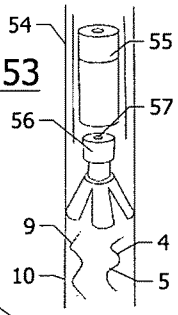
FIG. 53 depicts an explosive compression piston of the present inventor.

Referring now to FIGS. 52 and 53, the Figures depict a diagrammatic isometric view of a prior art shot gun and a diagrammatic isometric view of an apparatus for explosively crushing downhole well bore components, respectively, as described in GB2486591 by the present inventor. The present invention provides significant improvement over the explosive deformation of downhole conduit walls by providing pilotable tool string embodiments with shock absorbing and focusing capabilities. Similar to a prior art shot gun (51) which uses an explosive chamber (52) to propel objects from a barrel (53), a well bore's (10) walls (9) may be used as a barrel (54) from which an explosive arrangement (55) may be used to axially propel at least part of the various wall portions (4, 5), using an apparatus similar to a shotgun shell wad (56), with a pressure relief orifice (57). Axial pivotal pedal baskets are similar to a shotgun shell wad for propelling and/or wedging open the wall portions (4, 5), wherein an inverted pedal basket is usable to absorb the axial fluid hammer effect of using explosives within a well bore, as well as focusing an explosive fluid hammer in a particular axial direction like a shaped charge (40 of FIG. 23).

Figure 55:
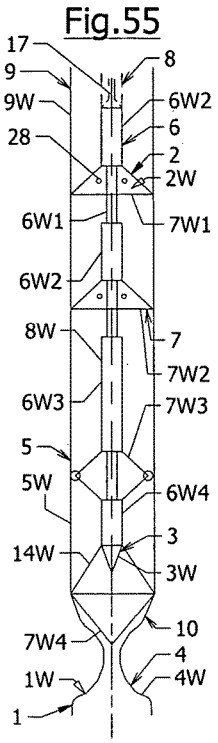

FIGS. 54 and 55 show diagrammatic elevation views of slices through a wellbore (10), illustrating method (1) embodiments (1Y, 1W, respectively) and apparatus (2) embodiments (2Y, 2W, respectively), which can be usable with a tool string (8) embodiment (8Y, 8W, respectively) and downhole device (3) comprising an explosive (3Y, 3W) for cutting, sculpting and/or wedging open a dissimilar passageway wall portion (4Y, 4W) to provide access or passage through a well bore's dissimilar contiguous passageway walls (9). An axial pivotal conical member (7, 7Y1), e.g. a pedal basket or cone wrap, is used to act against the axially above fluid column to limit lifting of the tool string (8Y) when an explosive (3Y) is fired, and inverted axial pivotal conical components (7Y3, 7W1-7W2), e.g. pedal baskets or conical wraps, can be used to focus a lower end fired explosive (3Y, 3W) axially downward from the shafts (6Y5, 6W4), to act on the frictionally obstructive innermost bore walls (4Y, 4W) protruding radially inward from the larger diameter (5Y, 5W) innermost passageway (9, 9Y, 9W).

Slips engaged to the axial pivotal members (7Y2, 7W3) can engage the tool strings (8Y, 8W) to the wellbore walls; hence, they may function as a bridge plug (35Y1, 35Y2) during firing of the explosives. For the tool string (8Y), the opposing conical axial pivotal members (7Y1, 7Y3), secured to the shafts (6Y3, 6Y4), can be mechanically linked to extend the slips to reduce the probability of upward movement of the tool string (8Y) and avoid an application of a fluid hammer effect to well equipment above the tool string or bird nesting of, e.g., a slickline string. The axial tension on the string to a shaft (6Y1), passing through an encompassing housing shaft (6Y2) and the upper conical funnel member (7Y1), may be used to release both the slips (7Y2) and lower conical funnel member (7Y3) and retract the upper conical funnel member (7Y1) with, e.g., retraction of an extending wedge (37T1 and 37T2 of FIGS. 36 to 43).

Upward movement of the tool string (8W) can be limited by, e.g., placing slip like profiles on the pedals of the inverted conical pedal basket or surface of the conical membrane, which are expanded by the fluid hammer associated with igniting the explosive (3W) to engage the conical forms (7W1, 7W2) and associated securing slips to the well bore (10) walls (9), wherein orifices (28) are provided to release excessive explosive pressures that may damage the axial pivotal members (7W1, 7W2). Initially the lower slips may be set and the cones expanded with upward axial movement of the central shaft (6W1), wherein after firing of the explosive charge (3W), the conical funnel slip members (7W1, 7W2) may be retracted by tensioning upon the surrounding shaft (6W2), engaged via a flexible hinge to the members (7W 1, 7W2) and associated shaft (6W3) to release the lower slips member (7W3).

Additionally to remove the possibility of creating a bird's nest of wire with, e.g., a slickline or electric line tool strings (8Y, 8W), the apparatuses (2Y, 2W) may be deployed, with the deployment strings (8) detached, and a timer used for firing the explosives (3Y, 3W), after which a retrieval string may be deployed to engage the upper end shaft and/or connection to pull the shock absorbing and focusing apparatuses (2Y, 2W). Removing the deployment string allows placement of, e.g., an inflatable packer or packer embodiment of the present invention above the apparatuses (2Y, 2W) to provide a backstop or secondary assurance that they will not be propelled uphole by an explosion downhole.

To provide passage through the restricted wall portion (4Y) an explosive device (3Y) can be usable to cut or sculpt the wall with, e.g. (1H, 1I, 1J) and (1M) of FIGS. 15-20 and FIG. 23, to provide additional space between the restricted circumferential walls. The method (1W) may use a conical axial pivotal member (7W4) to wedge the deformation and/or debris wall portion (4W) open to create more space between the restricted circumferential walls for access or passage, wherein the conical funnel wedge (7W4) is separable from the tool string (8W) to move axially downward and focus the explosion caused fluid hammer radially outward as the cone expands. A placement and/or fishing engagement linkage (14W) may be provided with the detachable wedge or it may be speared for retrieval. Alternatively, it may be explosively perforated, milled and/or pushed downhole or destroyed. Additionally, a method (1W) may follow a method (1Y) and be followed by a method (1Y), or any other method embodiment, to cut, sculpt and/or wedge open a wall portion, debris and/or debris from cutting, sculpting or wedging wall portions radially outward to form an larger effective pass through diameter.

Figure 56:
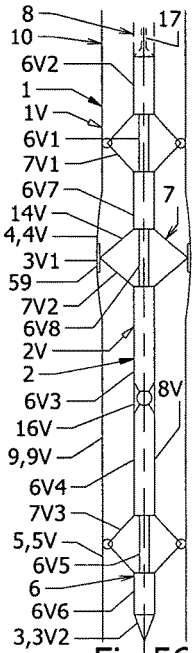
Figure 57:
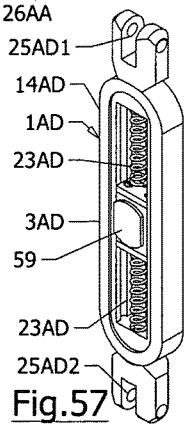

Referring now to FIGS. 56 and 57, FIG. 56 shows a diagrammatic elevation view of a slice through a well bore (10), illustrating a method (1) embodiment (1V) with apparatus (2) embodiment (2V) that can be usable with a tool string (8) embodiment (8V) and downhole device (3), and FIG. 57 shows an isometric view of a logging tool embodiment (1AD) sensor/transmitter (59), in a shock absorbing housing mechanical linkage (14) embodiment (14AD), which is shown using springs (23AD) to provide a shock absorbing cushion to movements from, e.g., explosive fluid hammers, wherein the embodiments are usable for providing a logging well bore image to provide empirical measurement data for access or passage through the walls of the dissimilar contiguous passageway walls (9V) of a well bore, during various operations, including passage and cutting or explosive operations that may cause significant shock or vibration.

A tool string (8) embodiment (8V) can use various mechanical arm deployed axial pivotal members (7V1-7V3), wherein a logging (59) downhole device (3V) may be engaged to an expandable pivotal component (7V2) to axially place the logging tool (3V1) sensor/transponder (59), comprising mechanical linkage (14AD), to provide, e.g., inclination logging information associated with tool string (8V) data collection, which can be transmitted through sonic pulses within, e.g., the casing wall where it may be collected from the wellhead in a similar manner described by the present inventor in GB2483675. An axial pivotal member can be usable to place the transmitter sensor on the casing while piloting a tool string (8V) through the well bores walls. As the axis within the walls of a dissimilar passageway (9) may be erratic, the tool string (8V) may have a ball joint, knuckle joint or flexible joint (6V) to provide inclination logging data between upper (6V3) and lower (6V4) shafts, as well as piloting of the tool string around restrictions or through wall portion enlargements (4V).

Data may be transmitted through electric line or fluid pulses within the fluid column, within the well bore (10), in various embodiments. Data transmittal is, however, complicated during slickline rotary cable tool positive fluid displacement motor operations, wherein transmittal through the wellbore's walls (9) provides an alternative, since slickline has no electrical core and upward pulses.

Accordingly, a logging downhole tool (3V, 3AD), which is formed with, e.g., a mechanical linkage (14AD), can be engaged to arms (14V), via flexible hinged connections (25AD1, 25AD2), and deployed via, e.g., tool string weight, string tension, springs and/or hydraulic actuator interoperability with shafts, including (6V1), (6V2), (6V3), (6V7) and (6V8), to maintain contact with the wellbore walls (9V) to, e.g., provide anti-rotation functionality and to perform logging operations to, in use, collect/transmit data through a sensor/transponder (59), which can collect or transmit data through the wellbore walls (9V), more or less on a continuous basis, via battery power supplemented by, e.g., a fluid turbine electrical generation tool within a tool string. For example, the circumferential adaptable logging apparatus (2V) can be combined with the boring apparatus (1X of FIG. 45) to allow continual monitoring of slickline boring data, such as stick slip and vibrational information that could limit the life of the tool string (8X, 8V).

Alternatively, an axial pivotal member (7V1) can be a combined anti-rotation conical funnel for directing a fluid shaft (6V7) comprising, e.g., a batter with a supplemental fluid turbine generator with fluid continuing through the shaft (6V8) and (6V3), which can comprise, e.g., a logging apparatus connected with the sensor (3V1), connected via a directional control joint (16V) to a fluid motor shaft (6V4), driving shaft (6V5), and through anti-rotation skates (7V3) to a rotary bit stick/slip inhibitor shaft (6V6) for turning a rotary bit (3V2). The efficiency of the vibration of the entire tool string (8V), as well as directional control, can be monitored continuously from the surface wellhead through pulses sent through the casing, via a transmitter's (59) engagement with the casing (9V).

Figure 58:
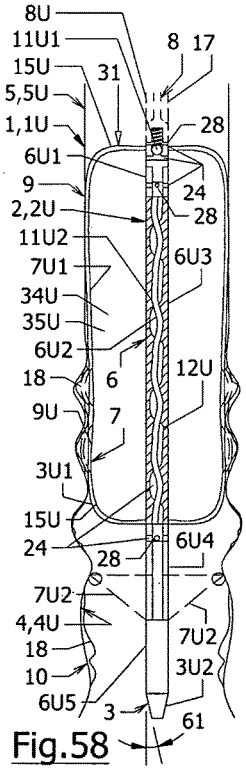

FIG. 58 depicts a diagrammatic elevation view of a slice through a well bore (10), illustrating a method (1) embodiment (1U) and apparatus (2) embodiment (2U) usable with a tool string (8) embodiment (8U) and downhole device (3) embodiment (3U1) for access or passage through the walls of the dissimilar contiguous passageways (9, 9U) of a well bore (10), including portions of the walls (4U, 5U). The movement of fluid filled single cell or multi-cell membrane balloons, bags or packers may be subject to significant frictional forces across substantially differing circumferences as the membrane conforms to the dissimilar walls (9U) and/or debris (18).

A membrane (7U1) can be usable as a packer (34U) and/or a bridge plug (35U) and may be inflated in various conventional ways, similar to those used to fill inflatable packers, which can include, e.g., a slickline pump, with other embodiments and downhole devices that can be used to axially displace, orient and align the assembly. Once filled, a fluid filled membrane may be traversed through dissimilar walls (9U) using a hole finder comprising, e.g., a tapered bull nose (3U2) engaged to a shaft (6U5) with a flexible skate (7U2), allowing fluctuations between a fully expanded and less than fully expanded flexible skate (7U2) to facilitate angular variation (61) of the shaft (6U5) and bullnose (3U2) from the proximal axis of the passageway (9U). The inflated membrane can, e.g., be pushed with surface fluid pressure (31) and vibrated through the passageway using a momentum vibrator embodiment (12U).

The upper valve (11U1) may be omitted to allow higher fluid differential pressure to follow its own chosen path, or to allow higher differential pressure trapped below to dominate with (11U1) placed, as shown, above upper orifice (28) in shaft (6U1) or to allow higher differential pressure from above to dominate with the one-way valve (11U1) placed immediately above lower orifice (28) in shaft (6U4). The fluid passing between the upper, lower and intermediate orifices (28 in shaft 6U1) can operate the positive displacement fluid relief valve (11V2) and momentum vibrator (12U) comprising, e.g., a helical rotor shaft (6U2) and stator shaft (6U3). Interoperability between the membrane (15U), valves (11U1 and/or 11U2) and momentum valve (12U) allow higher pressure to move to lower pressures, for example, pressure from an orifice (28) in a shaft (6U4) may fill the membrane through the intermediate orifice (28) in a shaft (6U1) or exit the upper orifice (28) in a shaft (6U1) above valve (11U1).

If pressure from above (31) overpressures the membrane (15U), by either forcing it downward against a restraining force or by filling it if the valve (11U1) is absent, fluid pressure may exit the membrane (15U) and exit below or above the membrane. Any transfer of fluid due to a differential pressure difference can operate the momentum vibrator to cause vibration and angular variation (61) to vibrate the membrane and shaft, while increasing and/or decreasing the membrane internal pressure to cause it to move in the desired direction (31).

Vibration of a piston packer is especially useful in the crushing of conduits and other well equipment downhole, as described in patent GB2471760B and priority patent application GB2484166A of the present inventor, wherein the downhole device (3U) may be, e.g., a connector to the conduit being crushed.

Accordingly, the present invention provides significant benefit over GB2471760B and GB2484166A by providing a means of reducing the resistance to crushing through, e.g., vibration and piloting of a packer, used as a piston, to crush downhole well components through the walls of dissimilar piston passageways of substantially differing circumference, thereby improving the ability to enable or provide cap rock restoration using the method (1) and apparatus (2) embodiments of the present invention.

FIG. 59 depicts a diagrammatic elevation view of a slice through a wellbore (10), illustrating a method (1) embodiment (1Z) and apparatus (2) embodiment (2Z) usable with a tool string (8) embodiment (8Z) and downhole device (3, 3Z) for access or passage through a well bore's obstructive dissimilar contiguous passageway walls (9Z1). A restriction (4, 4Z) can prevent passage of a prior art crushing piston, unsuited for piloting the substantially differing circumferences of the wellbore's (10) walls (9Z1), and the apparatus (2Z) with lower end hole finder (3Z) rigid or flexible bullnose suited to crushing tubing (9Z2) debris (18) within the casing (9Z1).

The circumferential adaptable apparatus uses offsetting conical axial pivotal members (7Z1, 7Z3) to form two pistons with an intermediate skate stabilizer (7Z2) and intermediate spring like devices (23Z1, 23Z2) usable to transfer energy between the pistons as the apparatus (2Z) passes through the restriction (4Z), wherein the crushing force associated with the larger diameter of the passage (9Z1) is maintained. Maintenance of the pressure against the larger diameter and associated force associated with the area of the larger circumference as the tool passes through the smaller diameter is maintained is provided by a passageway (24) through shafts which opens the nearest orifice (28) when a axial pivotal piston member is collapsed and closes the orifice when the piston expands.

Collapsing the lower piston (7Z3) against the restriction (4Z) opens the lower orifice (28) valve (11Z2) and bleeds off any trapped pressure between the pistons through the intermediate orifice that remains open and the upper pistons area controls the force applied. As the lower piston exits the restriction (4Z) into the larger internal diameter (5Z) and expands, the lower orifice (28) closes and crushing continues until the upper piston (7Z1) encounters the restriction and opens its valve (11Z1) to allow pressure against the lower piston to pull the apparatus (2Z) through the restriction (4Z).

Valves (e.g. 11Z1-11Z2) that selectively open and close according to the state of an expandable and collapsible axial pivotal member (7) may be formed within the various embodiments of the present invention by the disposition of various shafts within the plurality of shafts used by an apparatus (2) for traversing or placing the string (8) or various tools carried by the deployment string through an obstructed inner passageway. Spring like mechanisms (e.g.

23Z1, 23Z2) may be used to trap energy within an apparatus (e.g. 2Z) using their spring like their nature and the disposition of a plurality of shafts (e.g. 6Z1-6Z5) relative to the spring like mechanism, wherein energy may be placed within the shaft and spring like arrangement at surface or within a subterranean well bore using a downhole actuating device.

Axial and/or radial movement of a pivotal axial member (e.g. 7Z1-7Z3) may act against the plurality of shafts and spring like arrangement to, e.g., align orifices (e.g. 28 of FIG. 59) with a central fluid passageway through a central shaft (e.g. 6, 6Z1) and form valves (e.g. 11Z1, 11Z2) to transmit fluid between pressure differentials through, about and between sealing axial pivotal members (e.g. 7Z1, 7Z3) to, e.g., selectively apply pressure to plurality of crushing pistons (7Z1, 7Z3) to maximize the crushing force against debris (18, 9Z2) by selectively applying a pressure differential across the largest area (1Z).

While the restriction shown (4Z) is substantial, it also represents frictionally obstructive resistance to crushing from, e.g., a relatively consistent well bore wall with regular internal gaps associated with, e.g., conventional buttress casing couplings, upon which a piston might catch hold of or lose its seal, thus reducing the crushing force. Providing pistons energised by spring like mechanisms (23Z1, 23Z2) with valves (11Z1, 11Z2, 11U1-11U2 of FIG. 58), momentum vibrators (12U of FIG. 58), flexible joints (16V of FIG. 56), skates (26T1-26T2 of FIGS. 35-43) and/or other embodiments arranged to expand, seal and contract selectively according to well bore walls (9Z1), provides significant benefit over prior art by maximizing the forces and compression of downhole debris (18, 9Z2) when forming spaces for placement of a settable sealing material.

Additionally, the ability to place fluids through a central passage within a shaft or between shafts provides both momentum vibrate during crushing and forms a motor to provide, e.g., a reactive torque tractor within shaft (6Z2) to aid crushing of, e.g., production tubing (9Z2) to form debris (18) upon which a settable sealing material can be placed to abandon a well, and wherein axial pivotal member cutting wheel skates (26AC, 26AB, 26AA of FIGS. 46 to 51) and spring like mechanisms may be used with said pivotal tractor to aid crushing. The addition of vibration and/or the pull of a reactive torque tractor operated by, e.g., a positive displacement valve (11U2 of FIG. 56) may provide significant benefit to crushing when combined with differential pressure from the fluid column because, according to the laws of physics, objects that are at rest tend to stay at rest and objects in motion tend to stay in motion, hence providing a significant benefit over prior art.

Referring now to FIGS. 60 to 67, the Figures illustrate various views of method (1) embodiment (1AE) and apparatus (2) embodiment (2AE) usable with a tool string (8) embodiment (8AE) and downhole device (3) for access or passage through a wellbore's obstructive dissimilar contiguous passageway walls (9AE), wherein turbine blade (62) driven cutting (13AE) downhole devices (3AE) oriented with mechanical linkages (14AE1-14AE4), which can be usable to deform through cutting, milling or abrading a deformed wall portion (4AE) with a substantially differing circumference form an adjacent wall portion (5AE).

A series of shafts (6AE2-6AE11) surround and encompass various lengths of a central shaft (6AE1) with intermediate axial pivotal members (7AE1-7AE3) usable to operate the tool string (8AE) and downhole devices (3AE) comprising, e.g., cutting, brushing, milling or other abrasive outer circumference rings with offsetting turbine blade profiles (62) on the inside circumference of the rotating downhole device (3AE) cutters (13), wherein fluid (31) pumped from surface through the dissimilar passageway walls (9AE1, 9AE2) is funnelled by a conical pedal basket (22AE) in between turbine profiles (62) and central shaft (6AE1) to rotate the cutting (13) tools and mill or abrade a wall portion (4AE) with a substantially differing circumference than adjoining wall portions (5AE) of the well bore's (10) dissimilar passageway walls (9AE1, 9AE2).

Upper (26AE1) and lower (26AE2) anti-rotational skates are deployed via flexible hinge (25AE1-25AE10) engagement to associated shafts (6AE2-6AE3, 6AE8-6AE9) actuated with springs (23AE1, 23AE2) to substantially prevent rotation of the central shaft (6AE1) at shafts (6AE3, 6AE9) opposite sliding spring actuation shafts (6AE2, 6AE8), wherein said anti-rotation skates are usable across substantially differing circumferences. While opposing turbine blades (62) are shown between cutting ring (3AE1) and an adjacent cutting ring (3AE2) in FIG. 67 to illustrate the need to direct fluid (31) in one direction to turn a turbine blade shaped to direct fluid flow in a different direction, which is usable for various purposes, the torque and speed capability of the turbine blades may be increased significantly by fixing turbine blades to the central shaft held substantially stationary by anti-rotation skates (26AE1, 26AE2) to direct fluid flow (31) necessary to rotate the cutting rings (3AE1, 3AE2) by fluid force exerted against their associated rotatable turbine blades, wherein the stalling of a single ring does not stop fluid flow past nor rotation of another ring. Additionally, to improve the anti-rotation properties of the tool string (8AE) the profiles place don the central shaft (6AE1) may be used to direct the rotation of one ring (6AE1) in an opposite rotational direction to another ring (6AE2), wherein the fluid profiles of the central shaft would occur through passageways of an intervening enlarged shaft portion acting as a thrust bearing between cutting rings (3AE1, 3AE2) or turbine profiles covered by an thrust bearing shaft (6AE11) between the cutting ring (3AE1, 3AE2) downhole tools (3) and/or shafts they may thrust against.

FIGS. 60 and 61 show a plan view with line G-G and an elevation slice through line G-G of FIG. 60 with detail line H associated with FIG. 62, depicting method (1AE) and apparatus (2AE) within dissimilar contiguous passageway walls (9AE) with a break line illustrating a removed section, wherein other embodiments may be placed within the removed section, above and/or below the tool string (8AE). The fluid driven tool string (8AE) can be deployable and operable using, e.g., slickline which does have the capacity to circulate fluid, since it lacks a central fluid passageway, wherein fluid (31) may be pumped through the tubing (9AE2), e.g. 5½ inch outside diameter, within casing (9AE1), e.g. 9⅝ inch casing, and captured by a conical funnel (22AE) axial pivotal member (7AE2) to operate a series of rotatable cutting profile downhole devices (3AE).

Fluid flow (31) through the upper end of the wellbore (10) walls (9AE1, 9AE2) will pass the non-sealing anti-rotation axial pivotal member (7AE1) and be captured by the packer (34AE) sealing conical funnel (22AE) axial pivotal member (7AE2) to exit orifices (28) at its lower end and to enter the space between the central shaft (6AE1) and the turbine blade (62) rotated cutting (13) rings (3AE1, 3AE2), or any other axial length or shape of rotatable downhole device (3AE) with an internal circumferential turbine blade arrangement (62). Fluid can exit orifices (28) in the lower end shaft (6AE6) to progress down the wellbore walls (5AE, 9AE2).

FIGS. 62 and 63 show magnified detail views within line H of FIG. 61 and within line J of FIG. 62, respectively, showing the fluid flow (31) through the conical funnel's (22AE) lower end orifices (28), between the thrust bearing flexible hinge shaft (6AE5) and central shaft (6AE1), which can connect to the turbine blade (62 of FIG. 67) passageway between the turbine blade rotatable downhole tool (3AE) and the central shaft. Expansion of the conical funnel (22AE) comprises, e.g., placing a flexible hinge (25AE6) on the shaft (6AE5) axially above the adjacent shaft (6AE11) bearing any upward thrust from the rotatable rings (3AE) and engaging the funnel (22AE) flexible hinge (25AE5) to the central shaft (6AE1). Axially disposing the hinged (25AE6) shaft (6AE5) relative to the hinge (25AE5) on the central shaft (6AE1) can expand and collapse the funnel (22AE). Actuation of one shaft relative to the other may occur from various means, whereby a spring like mechanism, e.g. a spring operated expansion joint or hydraulic piston with trapped pressure, may be placed between the hinged shaft (6AE5) and thrust bearing shaft (6AE11). Tension on one of a possible plurality of shafts can collapse the funnel (22AE) when the tool string (8AE) is retrieved to surface for repair or replacement.

Referring now to FIGS. 64, 65 and 66, these figures depict an isometric cross section projection along line G-G of FIG. 60, wherein the tool string (8AE) is unsliced by the cross section, with detail lines K and L associated with FIGS. 65 and 66, respectively, depicting magnified detail views within lines K and L of FIG. 64. As visually illustrated by FIG. 64, the present invention is pilotable through and usable to engage substantially differing circumferences on either side of a drastic frictionally obstructive restricted circular or deformed circumference of a well bore (10), whereby prior art is primarily concerned with reopening a restricted passageway, keeping an ever increasing circular diameter from the lower end of a well bore (10) to the upper end. FIG. 65 illustrates that the rotatable rings may comprise an rotatable downhole material used in conventional practice, such as brush bristles, carbide impregnated surfaces, polycrystalline inserts, hard metals, or knife like profiles arranged in radial, axial, helical or any other pattern corresponding to the direction of rotation, while FIG. 66 illustrates how low profile (65) cutting (13) or frictional surfaces may be placed on wheels to enhance the anti-rotation capabilities of a skate (26AE1).

Additionally, prior art does not exist for performing the tasks described herein. For example, a slickline string may be used to deploy the tool string (8AE) adapted by removing the fluid exhaust orifice shaft (6AE6), placing ports and a passageway through the central shaft (6AE1) to the lower end of the apparatus (2AE) to operate a fluid motor, replacing shaft (6AE10), to operate a rotary drill bit to first bore through the restriction (4AE) and then polish or brush it with the rotatable turbine rings (3AE1, 3AE2), which may be arranged to allow counter rotation to offset the torque of the lower end motor to, in use, provide a significant improvement to rotary cable tool operations.

FIG. 67 shows isometric views of separated cutting surfaces (13) variation of a hydrodynamic fluid bearing shaft arrangement comprising a downhole device of a cutting circumferential adaptable apparatus (2AE) embodiment associated with FIG. 65, illustrating how turbine blades (62) may be arranged to rotate one ring (3AE1) relative to another (3AE2) as fluid (31) passes past the turbine blades (62). Profiles to direct fluids in the appropriate direction to cause opposite rotation (63, 64) may be placed between the cutting rings (3AE1, 3AE2) or rotation of the cutting rings via their turbine blades (62) may occur as friction causes one rings rotation to direct fluid in a direction to rotate an adjacent ring in the same or opposite direction. As turbine blades are an art unto themselves, the present invention does not seek to define their rotation various other aspects of their blade shapes and positioning with the various arrangements that may occur, but rather specifies that any arrangement of turbine suitable for the shafts and apparatus in question, may be piloted and operated by the present invention.

As demonstrated by the description and drawings provided herein, any combination or permeation of the described components of a circumferential adaptable apparatus embodiment (2) can be used with the various method embodiments (1), which are also applicable to place or traverse adaptations of conventional and prior art apparatus to urge access or passage through a subterranean well bore's (10) obstructive dissimilar contiguous passageway walls (9); formed by frictionally obstructive debris (18) within or at least a partially restricted circular or deformed circumferences (4, 5) thereof.

Additionally, while various embodiments of the present invention have been described with emphasis, it should be understood that within the scope of the appended claims, the present invention might be practiced other than as specifically described herein.

Reference numerals have been incorporated in the claims purely to assist understanding during prosecution.

The embodiments of the invention in which an exclusive property or privilege is claimed are defined as follows:

1. A method (1, 1A-1AE) of using a tool string and a downhole device with a circumferential adaptable apparatus to urge access or passage through an obstructive dissimilar contiguous passageway (9) of a subterranean well bore (10), said method comprising the steps of:

using the tool string (8A-8AE) comprising a deployment string (8) with a lower end coiled string compatible connector (17) engaged to an upper end shaft segment of a plurality of movable shaft segments (6, 6A-6AE) interoperable with at least one circumferential adaptable apparatus (2, 2A-2AE) and at least one downhole device (3, 3A-3AE, 11, 12, 19, 20, 24, 27, 28) deployed or removed through an upper end of the subterranean well bore and into or out of a lower end of said well bore to urge access or passage through the obstructive dissimilar contiguous passageway;

selectively arranging said tool string to use said at least one circumferential adaptable apparatus by engaging an axial pivotal member (7, 7A-7AE) hingeably attached, via a flexible hinge, to a lower end shaft segment on one end of the axial pivotal member and usable with said at least one downhole device on an opposite end of the axial pivotal member, wherein said obstructive dissimilar contiguous passageway comprises a first (4, 4A-4AE) and at least a second (5, 5A-5AE) wall portion comprising an obstruction formed by at least one of: an obstructive partially restricted circular or deformed circumference, frictionally obstructive walls, or frictionally obstructive debris (18) therein; and using said engagement of said at least one circumferential adaptable apparatus and said at least one downhole device, between said first or said at least a second wall portion, to adapt a circumference of said at least one circumferential adaptable apparatus to operate said flexible hinge and to selectively orient said at least one circumferential adaptable apparatus and said at least one downhole device to pilot said tool string by: axially or radial outwardly deforming said obstruction to provide access to, or traversing said obstruction to provide passage through, said obstructive dissimilar contiguous passageway.

2. The method according to claim 1, further comprising the step of actuating said at least one circumferential adaptable apparatus (2) or said at least one downhole device by using tension of said deployment string (8), to pilot said tool string.

3. The method according to claim 1, further comprising the step of actuating said at least one downhole device to selectively orient said at least one circumferential adaptable apparatus (2) and said at least one downhole device or orient said lower end shaft segment carrying said at least one circumferential adaptable apparatus or said at least one downhole device to, in use, dispose said tool string radially, axially, or combinations thereof, to pilot said tool string.

4. The method according to claim 1, further comprising the step of providing a fluid control device, a permeable membrane, or combinations thereof, to selectively operate fluid used to pilot said tool string.

5. The method according to claim 1, further comprising the step of providing a positive fluid displacement valve, a momentum vibrator, or combinations thereof, for actuating said at least one downhole device (11, 12) to repeatedly move, reorient, and pilot said tool string.

6. The method according to claim 1, further comprising the step of providing a hydraulic actuator, an electric actuator, an explosive actuator, or combinations thereof, for actuating said at least one downhole device to pilot said tool string or provide a pilotable passageway.

7. The method according to claim 6, further comprising the step of using said axial pivotal member (7) to focus, absorb, or combinations thereof, an explosive force of said at least one downhole device (19, 20) usable to perforate or sculpt at least part of said obstructive dissimilar contiguous passageway to pilot said tool string or provide a pilotable passageway.

8. The method according to claim 6, further comprising the step of providing an actuating downhole device comprising an electric downhole motor or a hydraulic downhole motor (21) to pilot said tool string or provide a pilotable passageway.

9. The method according to claim 8, further comprising the step of providing a positive displacement fluid rotor and stator, a fluid turbine, or combinations thereof, to said actuating downhole device to pilot said tool string or provide a pilotable passageway.

10. The method according to claim 1, wherein said at least one axial pivotal member (7) is expandable, collapsible, or combinations thereof, and is selectively operable by said actuating downhole device to control an effective diameter of said at least one axial pivotable member and operate, orient, engage or disengage said tool string to or from at least part of said obstructive dissimilar contiguous passageway and to pilot said tool string or operate fluids used to pilot said tool string.

11. The method according to claim 10, further comprising the step of providing said axial pivotal member (7) with at least one shaped or deformable member of a group consisting of a packer (34), a bridge plug (35), a pedal basket (22), a membrane (15), a mechanical arm linkage (14), a wheeled mechanical linkage (26), and combinations thereof.

12. The method according to claim 1, further comprising the step of providing at least two shaft segments of said plurality of movable shaft segments with an intermediate spring like joint (23), a knuckle joint (16), a hinged joint (25), a ball joint, or combinations thereof, usable to operate, selectively orient and pilot said tool string.

13. The method according to claim 1, further comprising the step of using a cutter deployed by said at least one circumferential adaptable apparatus or said at least one downhole device to forcibly deform at least part of said obstruction radially outward, axially, or combinations thereof, to provide a pilotable passageway to pilot said tool string.

14. The method according to claim 13, further comprising the step of operating a cutting device secured to at least one shaft (6) of said plurality of shaft segments, said axial pivotal component (7), or combinations thereof.

15. The method according to claim 14, further comprising the step of deforming said obstructive dissimilar contiguous passageway (9) using a mechanical cutter (13), a chemical cutter, an explosive cutter, or combinations thereof.

16. The method according to claim 13, further comprising the step of providing a wedging device (37), a wedge formed by said axial pivotal component (7), or combinations thereof, usable with at least one shaft of or at least one detachable shaft of said plurality of shaft segments to forcibly deform said obstruction with a differential pressure or force applied across said wedging device, said wedge, or combinations thereof.

17. The method according to claim 1, further comprising the step of providing an encompassing shaft segment that encompasses an axially movable shaft segment of said plurality of movable shaft segments to actuate said at least one circumferential adaptable apparatus (2) and said at least one downhole device or to actuate said lower end shaft segment carrying said at least one circumferential adaptable apparatus or said at least one downhole device to pilot said tool string.

18. The method according to claim 1, further comprising the step of providing said plurality of movable shaft segments with at least one flexible shaft, at least one rigid shaft, or combinations thereof, usable to pilot said tool string.

19. The method according to claim 1, further comprising the step of providing said plurality of movable shaft segments with at least one rotating shaft segment, at least one substantially stationary shaft segment, or combinations thereof, usable to pilot said tool string.

20. The method according to claim 1, further comprising the step of providing at least one dog, a slip, a shear pin, a mandrel, or combinations thereof, to engage and selectively hold or disengage at least two parts of said at least one circumferential adaptable apparatus, said at least one downhole device, an additional downhole device, or shaft segments of said plurality of movable shaft segments.

21. The method according to claim 1, further comprising the step of using a hole finding orientation tool string member comprising a flexible arrangement of said plurality of movable shaft segments or a hole finder carried by said tool string and interoperable with said at least one circumferential adaptable apparatus to, in use, pilot said tool string.

22. The method according to claim 1, further comprising the step of using said tool string to deform at least one smaller effective diameter obstruction into a larger effective diameter pilotable passageway for access or passage.

23. The method according to claim 1, further comprising the step of using said tool string to pilot a lining into said obstruction to form a pilotable passageway for access or passage.

24. The method according to claim 1, further comprising the step of imaging said obstructive dissimilar contiguous passageway with a logging tool of said at least one downhole device selectively oriented by said at least one circumferential adaptable apparatus (2) to provide empirical imaging data to selectively arrange said tool string or to pilot said tool string.

25. A circumferential adaptable apparatus (2, 2A-2AE) used (1, 1A-1AE) to urge access or passage through an obstructive dissimilar contiguous passageway (9) of a subterranean well bore (10), said circumferential adaptable apparatus comprising:

at least one circumferential adaptable apparatus (2) with an axial pivotal member (7, 7A-7AE) hingeably attached, via a flexible hinge, to a lower end shaft segment on one end of the axial pivotal member, and usable with at least one downhole device (3, 3A-3AE, 11, 12, 19, 20, 24, 27, 28) on an opposite end of the axial pivotal member, to engage said at least one circumferential adaptable apparatus and said at least one downhole device or the lower end shaft segment of a plurality of movable shaft segments (6, 6A-6AE) carrying said at least one circumferential adaptable apparatus or said at least one downhole device, wherein said at least one circumferential adaptable apparatus and said at least one downhole device are selectively arranged within and carried by a tool string (8A-8AE) comprising a deployment string (8) with a lower end coiled string compatible connector (17) engaged to an upper end shaft segment of said plurality of movable shaft segments, wherein said at least one circumferential adaptable apparatus (2) and said at least one downhole device and said tool string are interoperable and deployed or removed through an upper end of said subterranean well bore and into or out of a lower end of said subterranean well bore to urge access or passage through said obstructive dissimilar contiguous passageway comprising substantially differing effective circumferences, with a first (4, 4A-4AE) and at least a second (5, 5A-5AE) wall portion, comprising an obstruction formed by at least one of: an obstructive partially restricted circular or deformed circumference, frictionally obstructive walls, or frictionally obstructive debris (18) therein, and wherein the engagement of said at least one circumferential adaptable apparatus and said at least one downhole device between said first or said at least a second wall portion adapts a circumference of said at least one circumferential adaptable apparatus to operate said flexible hinge and to selectively orient said at least one circumferential adaptable apparatus and said at least one downhole device to pilot said tool string by: axially or radial outwardly deforming said obstruction to provide said access to, or by traversing said obstruction to provide said passage through, said obstructive dissimilar contiguous passageway.

26. The apparatus according to claim 25, wherein said at least one circumferential adaptable apparatus is actuated (2) by tension of said deployment string (8), actuation of said at least one downhole device, or combinations thereof, to pilot said tool string.

27. The apparatus according to claim 25, wherein actuating said at least one downhole device selectively orients said at least one circumferential adaptable apparatus and said at least one downhole device to dispose said tool string radially, axially, or combinations thereof, to, in use, pilot said tool string.

28. The apparatus according to claim 25, wherein said at least one circumferential adaptable apparatus (2) further comprises a fluid control device, a permeable membrane, or combinations thereof, to selectively operate fluid used to pilot said tool string.

29. The apparatus according to claim 25, wherein said at least one circumferential adaptable apparatus (2) further comprises a positive fluid displacement valve, a momentum vibrator, or combinations thereof, for actuating a member of said at least one downhole device (11, 12) to selectively operate fluid used to pilot said tool string.

30. The apparatus according to claim 29, wherein said positive fluid displacement valve or said momentum vibrator pilots said tool string by moving and reorienting said at least one circumferential adaptable apparatus and said at least one downhole device.

31. The apparatus according to claim 30, wherein said at least one downhole device or said at least one circumferential adaptable apparatus (2) further comprises a plurality of movable shaft segments with: a helical nodal rotor shaft within an associated helical nodal stator housing shaft; or an inner shaft within an encompassing outer housing shaft with opposing turbine blades (62) on one or more of said inner or outer shafts, wherein a first shaft rotates relative to a second shaft via a differential fluid pressure applied to said helical nodes or turbine blades to communicate fluids used to pilot said tool string.

32. The apparatus according to claim 25, wherein said at least one circumferential adaptable apparatus (2) further comprises a hydraulic actuator, an electric actuator, an explosive actuator, or combinations thereof, for actuating said at least one downhole device to pilot said tool string or provide a pilotable passageway.

33. The apparatus according to claim 32, wherein said at least one circumferential adaptable apparatus (2) further comprises an explosive cutting device for perforating (20), sculpting (19), or combinations thereof, said obstructive dissimilar contiguous passageway to pilot said tool string or provide a pilotable passageway.

34. The apparatus according to claim 2, wherein said axial pivotal member (7) is arranged for interoperability with said plurality of movable shaft segments (6) to focus, absorb, or combinations thereof, energy of said perforating or sculpting to, in use, pilot said tool string or provide a pilotable passageway.

35. The apparatus according to claim 32, wherein said at least one circumferential actuating apparatus (2) further comprises an electrical downhole motor or a hydraulic downhole motor usable to pilot said tool string or provide a pilotable passageway.

36. The apparatus according to claim 25, wherein said axial pivotal member (7) is expandable or collapsible using said at least one downhole device or said at least one circumferential adaptable apparatus to dispose at least a second shaft segment of said plurality of movable shaft segments relative to said flexible hinge, wherein expansion or collapse of said axial pivotal member (7) controls a diameter thereof and operates, orients, engages or disengages said tool string to or from at least part of said obstructive dissimilar contiguous passageway to pilot said tool string or operate fluids used to pilot said tool string or provide a pilotable passageway.

37. The apparatus according to claim 36, wherein said axial pivotal member (7) comprises a functionally shaped controllably deformable material, a functionally shaped substantially rigid material, or combinations thereof.

38. The apparatus according to claim 36, wherein said at least one axial pivotal member (7) comprises a packer (34), a bridge plug (35), a pedal basket (22), a membrane (15), or combinations thereof.

39. The apparatus according to claim 36, wherein said at least one axial pivotal member (7) comprises at least one mechanical arm linkage (14), at least one wheeled mechanical linkage (26), or combinations thereof.

40. The apparatus according to claim 25, wherein said at least one circumferential adaptable apparatus (2) or said at least one downhole device further comprises a cutter member deployed to forcibly deform at least part of said obstruction radially outward, axially, or combinations thereof, to provide a pilotable passageway to pilot said tool string.

41. The apparatus according to claim 40, wherein said cutter member is operated by at least one shaft of said plurality of shaft segments, said axial pivotal member (7), or combinations thereof.

42. The apparatus according to claim 41, wherein said cutter member comprises a mechanical cutter (13), a chemical cutter, an explosive cutter, or combinations thereof.

43. The apparatus according to claim 40, wherein said at least one circumferential adaptable apparatus comprises a wedging downhole device member, a wedging member formed by said axial pivotal member (7), or combinations thereof, usable with at least one shaft or at least one detachable shaft of said plurality of movable shaft segments to forcibly deform said obstruction with a differential pressure or force applied across said wedging downhole device member, said wedging member, or combinations thereof.

44. The apparatus according to claim 25, wherein said at least one circumferential adaptable apparatus (2) or said plurality of movable shaft segments further comprises at least two shaft segments axially oriented by an intermediate spring joint (23), a knuckle joint (16), a hinged joint (25), a ball joint, or combinations thereof, arranged to operate, orient and pilot said tool string.

45. The apparatus according to claim 25, wherein said at least one circumferential adaptable apparatus (2) or said plurality of movable shaft segments further comprises an axially movable shaft segment within an encompassing shaft segment usable to actuate a member of said at least one circumferential adaptable apparatus (2) and said at least one downhole device or to actuate said lower end shaft segment carrying said at least one circumferential adaptable apparatus or said at least one downhole device to pilot said tool string.

46. The apparatus according to claim 25, wherein said at least one circumferential adaptable apparatus (2) or said plurality of movable shaft segments further comprises at least one substantially flexible shaft, at least one substantially rigid shaft, or combinations thereof, usable to pilot said tool string.

47. The apparatus according to claim 25, wherein said at least one circumferential adaptable apparatus (2) or said plurality of movable shaft segments further comprises at least one rotating shaft segment, at least one substantially stationary shaft segment, or combinations thereof, usable to pilot said tool string.

48. The apparatus according to claim 25, wherein said at least one circumferential adaptable apparatus (2), said at least one downhole device or said plurality of movable shaft segments further comprises at least one dog, a slip, a shear pin, a mandrel, or combinations thereof, for engaging and selectively holding or disengaging at least two members thereof.

49. The apparatus according to claim 25, wherein said at least one circumferential adaptable apparatus (2) or said plurality of movable shaft segments further comprises a flexible shaft segment or an arrangement of shaft segments selectively arranged to be flexibly oriented by said axial pivotal component (7) to form a hole finding tool usable to pilot said tool string.

50. The apparatus according to claim 25, wherein said at least one circumferential adaptable apparatus further comprises an imaging logging downhole device selectively oriented by said at least one circumferential adaptable apparatus (2) to image said obstructive dissimilar contiguous passageway to provide empirical data to selectively arrange said tool string or to pilot said tool string.

* * * * *